US008472840B2

(12) United States Patent
Abe et al.

(10) Patent No.: US 8,472,840 B2
(45) **Date of Patent: *Jun. 25, 2013**

(54) PROCESS CARTRIDGE WITH DRUM FLANGE HAVING REGULATED PORTIONS

(75) Inventors: Daisuke Abe, Suntou-gun (JP); Masanari Morioka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/369,778

(22) Filed: Feb. 9, 2012

(65) Prior Publication Data

US 2012/0201566 A1 Aug. 9, 2012

Related U.S. Application Data

(62) Division of application No. 12/241,185, filed on Sep. 30, 2008, now Pat. No. 8,135,304.

(30) Foreign Application Priority Data

Jun. 20, 2008 (JP) ..... 2008-161529

(51) Int. Cl.
*G03G 15/00* (2006.01)
*G03G 21/16* (2006.01)

(52) U.S. Cl.
USPC ..... 399/111; 399/117; 399/167

(58) Field of Classification Search
USPC ..... 399/111, 167
See application file for complete search history.

(56) References Cited

U.S. PATENT DOCUMENTS 5,070,366 A 12/1991 Tsuchiya
5,594,531 A 1/1997 Shishido et al.
5,640,650 A 6/1997 Watanabe et al.
5,903,803 A 5/1999 Kawai et al.
5,930,562 A 7/1999 Noda et al.
6,128,454 A 10/2000 Kawai et al.
6,175,706 B1 1/2001 Watanabe et al.
6,226,478 B1 5/2001 Watanabe et al.

(Continued)

FOREIGN PATENT DOCUMENTS

CN 1188266 7/1998
JP 2875203 1/1999

(Continued)

OTHER PUBLICATIONS

Office Action in Chinese Patent Application No. 200880129816.7, mailed Apr. 17, 2012 (with English translation).

(Continued)

*Primary Examiner* — Walter L. Lindsay, Jr.
*Assistant Examiner* — David Bolduc
(74) *Attorney, Agent, or Firm* — Fitzpatrick, Cella, Harper & Scinto

(57) ABSTRACT

A process cartridge comprises an electrophotographic photosensitive drum and a developing roller. A coupling member is provided that receives a rotating force for rotating the electrophotographic photosensitive drum and transmits the rotating force to the electrophotographic photosensitive drum through a drum flange. The drum flange has (i) a first regulated portion capable of being regulated by a first regulating portion, (ii) a second regulated portion capable of being regulated by a second regulating portion, (iii) a connecting portion that is connected with the coupling member so that a rotational axis of the coupling member is inclineable relative to a rotational axis of the drum flange, and (iv) a gear portion that transmits the rotational force from the coupling member to the developing roller.

6 Claims, 21 Drawing Sheets

U.S. PATENT DOCUMENTS

| | | | |
|---|---|---|---|
| 6,240,266 | B1 | 5/2001 | Watanabe et al. |
| 6,334,035 | B1 | 12/2001 | Abe et al. |
| 6,349,188 | B1 | 2/2002 | Kawai et al. |
| 6,377,759 | B1 | 4/2002 | Abe et al. |
| 6,400,914 | B1 | 6/2002 | Noda et al. |
| 6,463,225 | B1 | 10/2002 | Abe et al. |
| 6,473,585 | B2 | 10/2002 | Abe et al. |
| 6,501,926 | B1 | 12/2002 | Watanabe et al. |
| 6,501,927 | B1 | 12/2002 | Watanabe et al. |
| 6,505,008 | B2 | 1/2003 | Abe |
| 6,535,699 | B1 | 3/2003 | Abe et al. |
| 6,704,522 | B2 | 3/2004 | Sasago et al. |
| 6,714,746 | B2 | 3/2004 | Morioka et al. |
| 6,823,155 | B2 | 11/2004 | Tsuda et al. |
| 6,885,838 | B2 | 4/2005 | Kawai et al. |
| 6,898,399 | B2 | 5/2005 | Morioka et al. |
| 6,934,485 | B2 | 8/2005 | Miyabe et al. |
| 6,937,832 | B2 | 8/2005 | Sato et al. |
| 6,963,706 | B2 | 11/2005 | Morioka et al. |
| 6,993,264 | B2 | 1/2006 | Oguma et al. |
| 6,999,696 | B2 | 2/2006 | Noda et al. |
| 7,079,787 | B2 | 7/2006 | Ogino et al. |
| 7,092,655 | B2 | 8/2006 | Noda et al. |
| 7,127,192 | B2 | 10/2006 | Batori et al. |
| 7,162,176 | B2 | 1/2007 | Oguma et al. |
| 7,200,349 | B2 | 4/2007 | Sato et al. |
| 7,203,442 | B2 | 4/2007 | Matsubara et al. |
| 7,231,161 | B2 | 6/2007 | Noda et al. |
| 7,242,885 | B2 | 7/2007 | Abe et al. |
| 7,248,814 | B2 | 7/2007 | Kawai et al. |
| 7,274,896 | B2 | 9/2007 | Kawai et al. |
| 7,315,706 | B2 | 1/2008 | Oguma et al. |
| 7,403,733 | B2 | 7/2008 | Watanabe et al. |
| 7,418,225 | B2 | 8/2008 | Morioka et al. |
| 2002/0018666 | A1 | 2/2002 | Noda et al. |
| 2002/0025191 | A1 | 2/2002 | Kitayama |
| 2005/0047821 | A1 | 3/2005 | Murayama et al. |
| 2005/0281586 | A1 | 12/2005 | Ohashi |
| 2006/0061829 | A1 | 3/2006 | Yamazaki |
| 2006/0067737 | A1 | 3/2006 | Yamazaki |
| 2006/0240896 | A1 | 10/2006 | Ohashi et al. |
| 2007/0104510 | A1 | 5/2007 | Kawai et al. |
| 2007/0122188 | A1 | 5/2007 | Igarashi |
| 2007/0147884 | A1 | 6/2007 | Tanaka |
| 2007/0280727 | A1 | 12/2007 | Kawasumi |
| 2008/0019720 | A1 | 1/2008 | Kawakami |
| 2008/0056754 | A1 | 3/2008 | Noda et al. |
| 2008/0152388 | A1 | 6/2008 | Ueno et al. |
| 2008/0260428 | A1 | 10/2008 | Ueno et al. |
| 2009/0028597 | A1 | 1/2009 | Takigawa |

FOREIGN PATENT DOCUMENTS

| | | | |
|---|---|---|---|
| JP | 2006-171785 | | 6/2006 |
| JP | 2006-208808 | | 8/2006 |
| JP | 2008-58458 | | 3/2008 |
| RU | 2289835 | C2 | 12/2006 |
| RU | 2324965 | C1 | 5/2008 |
| WO | 2008081966 | | 7/2008 |

OTHER PUBLICATIONS

Official Communication in Korean Patent Application No. 10-2011-7000859, mailed May 10, 2012.

English translation of Official Communication in Korean Patent Application No. 10-2011-7000859, mailed May 10, 2012.

PCT International Search Report and Written Opinion of International Search Authority in PCT/JP2008068130 issued Jun. 8, 2009.

Decision on Grant in Russian Patent Application No. 2011101932/28, issued Feb. 26, 2013 (with English Translation).

Notice of Allowance in Korean Patent Application No. 10-2011-7000859, issued Mar. 25, 2013.

PROCESS CARTRIDGE WITH DRUM FLANGE HAVING REGULATED PORTIONS

This application is a divisional of co-pending U.S. patent application Ser. No. 12/241,185, filed Sep. 30, 2008.

FIELD OF THE INVENTION AND RELATED ART

The present invention relates to a process cartridge, and an electrophotographic image forming apparatus in which a process cartridge is removably mountable.

In the case of the present invention, a process cartridge is a cartridge in which an electrophotographic photosensitive member, and means for processing an electrophotographic photosensitive member, are integrally disposed to enable the electrophotographic photosensitive member and processing means to be removably mounted in the main assembly of an electrophotographic image forming apparatus. For example, it is a cartridge in which an electrophotographic photosensitive member, and at least one processing means among a developing means, a charging means, and cleaning means, are integrally disposed, a cartridge in which an electrophotographic photosensitive member, and the charging means and cleaning means among the abovementioned processing means, are integrally disposed, or a cartridge in which an electrophotographic photosensitive member, and a developing means, that is, one of the abovementioned processing means, are integrally disposed.

An electrophotographic image forming apparatus is an apparatus which forms an image on recording means with the use of an electrophotographic image forming method. As examples of an electrophotographic image forming apparatus, there may be included an electrophotographic printer (LED printer, laser beam printer, etc.), a facsimile apparatus, a word processor, etc.

Further, the main assembly of an electrophotographic image forming apparatus is the portion of the image forming apparatus, which remains after the removal of all process cartridges in the image forming apparatus.

A process cartridge system has long been in use in the field of an electrophotographic image forming apparatus, that is, an image forming apparatus which uses an electrophotographic image formation process. A process cartridge system makes it possible for a user to maintain an electrophotographic image forming apparatus without relying on a service person at all. Thus, it has significantly improved an electrophotographic image forming apparatus in maintainability.

It has been known that it is from the main assembly of an image forming apparatus that a process cartridge in accordance with the art prior to the present invention receives the driving force for rotating its electrophotographic photosensitive drum (which hereafter may be referred to simply as photosensitive drum). It has also been known that the structural arrangement for the process cartridge to receive the driving force from the main assembly is as follows:

The main assembly of an image forming apparatus is provided with a rotatable member for transmitting the driving of a motor to a process cartridge. The rotatable member has a hole, which is noncircular in cross section. More specifically, the hole is in the shape of a twisted polygonal column, having therefore multiple apexes, and its axial line coincides with that of the rotatable member.

The process cartridge is provided with a projection, which is noncircular in cross section, having therefore multiple apexes. The projection is attached to one of the lengthwise ends of the photosensitive drum, and fits into the abovementioned hole of the rotatable member of the apparatus main assembly.

As the rotatable member of the apparatus main assembly is rotated after the mounting of the process cartridge into the apparatus main assembly, that is, the fitting of the abovementioned projection of the process cartridge into the hole of the rotational member of the apparatus main assembly, the projection is subjected to a force which acts in the direction to the pull the projection into the hole of the rotatable member of the apparatus main assembly, and the rotational force, which the rotational member possesses, is transmitted to the photosensitive drum, with the projection remaining under the abovementioned force. That is, the rotational force for rotating the photosensitive drum is transmitted from the apparatus main assembly to the photosensitive drum (U.S. Pat. No. 2,875,203).

This technology regarding the structure of an electrophotographic image forming apparatus is very effective to transmit rotational force to a photosensitive drum.

The present invention is one of the results of the further development of the abovementioned prior technology.

SUMMARY OF THE INVENTION

Thus, the primary object of the present invention is to provide a process cartridge capable of positioning its coupling, which is for receiving a rotational force from the main assembly of an image forming apparatus, relative to the rotational force transmitting portion of the apparatus main assembly, in terms of the axial line of the rotational force transmitting portion, at a significantly higher level of accuracy than a process cartridge in accordance with the art prior to the present invention.

Another object of the present invention is to provide a process cartridge which can be mounted in the main assembly of an electrophotographic image forming apparatus having no mechanism for moving the rotational member of the apparatus main assembly, that is, the driving force transmitting portion of the apparatus main assembly, which is for transmitting a rotational force to the electrophotographic photosensitive drum.

Another object of the present invention is to provide a process cartridge, the electrophotographic photosensitive drum of which rotates at a significantly higher level of accuracy than that of a process cartridge which employs nothing but gears to transmit a rotational force from the apparatus main assembly to the process cartridge.

Another object of the present invention is to provide an electrophotographic image forming apparatus in which any of the above described process cartridges can removably mountable.

Another object of the present invention is to provide a process cartridge capable of precisely aligning the axial line of its electrophotographic photosensitive member with the axial line of the counterpart of the main assembly of an electrophotographic image forming apparatus.

Another object of the present invention is to provide a process cartridge capable of precisely aligning the axial line of its coupling with the axial line of the counterpart of the main assembly of an electrophotographic image forming apparatus.

Another object of the present invention is to provide an electrophotographic image forming apparatus in which any of the process cartridges described above is removably mountable.

According to an aspect of the present invention, there is provided a process cartridge detachably mountable to a main assembly of an electrophotographic image forming apparatus. The electrophotographic image forming apparatus includes a rotating force applying portion, comprising an electrophotographic photosensitive drum; a developing roller for developing an electrostatic latent image formed on the electrophotographic photosensitive drum; a first frame unit supporting the electrophotographic photosensitive drum; a second frame unit supporting the developing roller and swingably connected with the first frame unit; a coupling, mounted to one end portion of the electrophotographic photosensitive drum, for receiving a rotating force for rotating the electrophotographic photosensitive drum from the rotating force applying portion in the state in which the process cartridge is mounted to the main assembly of the apparatus; a first cartridge side portion to be positioned engageable with a first main assembly side positioning portion provided in the main assembly of the apparatus to regulate movement of the first frame unit in a longitudinal direction of the electrophotographic photosensitive drum in the state in which the process cartridge is mounted to the main assembly of the apparatus; a second cartridge side portion to be positioned which is provided coaxially with an axis of the electrophotographic photosensitive drum at one longitudinal end of the first frame unit and which is engageable with a second main assembly side positioning portion provided in the main assembly of the apparatus to position the electrophotographic photosensitive drum in a radial direction relative to the main assembly of the apparatus in the state in which the process cartridge is mounted to the main assembly of the apparatus; a third cartridge side portion to be positioned which is provided coaxially with the axis of the electrophotographic photosensitive drum at the other longitudinal end of the first frame unit and which is engageable with a third main assembly side positioning portion provided in the main assembly of the apparatus to position the electrophotographic photosensitive drum in a radial direction relative to the main assembly of the apparatus in the state in which the process cartridge is mounted to the main assembly of the apparatus; a first unit side regulating portion provided in the first frame unit to regulate movement of the electrophotographic photosensitive drum in the longitudinal direction of the first frame unit; and a first drum side regulating portion provided on the electrophotographic photosensitive drum so as to contact the first unit side regulating portion thereby to regulate movement of the electrophotographic photosensitive drum in the longitudinal direction of said first frame unit.

According to another aspect of the present invention there is provided a process cartridge detachably mountable to a main assembly of an electrophotographic image forming apparatus. The electrophotographic image forming apparatus includes a rotating force applying portion, comprising an electrophotographic photosensitive drum; a drum flange provided at one end of the electrophotographic photosensitive drum, the drum flange including a gear and one end drum shaft; a coupling, mounted to the drum flange, for receiving a rotating force for rotating the electrophotographic photosensitive drum from the rotating force applying portion in the state in which the process cartridge is mounted to the main assembly of the apparatus; a developing roller rotatable by the rotating force received from the rotating force applying portion by the coupling to develop an electrostatic latent image formed on the electrophotographic photosensitive drum; a first frame unit for supporting the one end of the electrophotographic photosensitive drum through a bearing member supporting the one end side drum shaft and for supporting the other of the electrophotographic photosensitive drum through a bearing member supporting the other end side drum shaft; a second frame unit supporting the developing roller and swingably connected with the first frame unit; a first cartridge side portion to be positioned, provided on the bearing member, for engagement with a first main assembly side positioning portion provided in the main assembly of the apparatus to regulate movement of the first frame unit in a longitudinal direction of the electrophotographic photosensitive drum in the state in which said process cartridge is mounted to the main assembly of the apparatus; a second cartridge side portion to be positioned which is provided coaxially with an axis of said electrophotographic photosensitive drum at one longitudinal end of the first frame unit and which is engageable with a second main assembly side positioning portion provided in the main assembly of the apparatus to position the electrophotographic photosensitive drum in a radial direction relative to the main assembly of the apparatus in the state in which the process cartridge is mounted to the main assembly of the apparatus; a third cartridge side portion to be positioned which is provided coaxially with the axis of the electrophotographic photosensitive drum at the other longitudinal end of the first frame unit and which is engageable with a third main assembly side positioning portion provided in the main assembly of the apparatus to position the electrophotographic photosensitive drum in a radial direction relative to the main assembly of the apparatus in the state in which the process cartridge is mounted to the main assembly of the apparatus;

a first unit side regulating portion, provided at the one longitudinal end of the first frame unit, for regulating movement of the electrophotographic photosensitive drum in a direction from the one end toward the other end a second unit side regulating portion, provided on the bearing member, for regulating movement of the electrophotographic photosensitive drum in a direction from the other end toward the one end; and a first unit side regulating portion provided in the first frame unit so as to contact the first unit side regulating portion thereby to regulate movement of the electrophotographic photosensitive drum in the direction from the one end to the other end of the electrophotographic photosensitive drum; a first drum side regulating portion provided on the electrophotographic photosensitive drum so as to contact the second unit side regulating portion thereby to regulate movement of the electrophotographic photosensitive drum in the from the other end to the one end of the electrophotographic photosensitive drum.

According to a further aspect of the present invention, there is provided an electrophotographic image forming apparatus including a main assembly of the apparatus to which a process cartridge is detachably mountable. The apparatus comprises i) a first main assembly side positioning portion;

ii) a second main assembly side positioning portion;

iii) a third main assembly side positioning portion;

iv) a rotating force applying portion;

v) the process cartridge including, a electrophotographic photosensitive drum; a developing roller for developing an electrostatic latent image formed on the electrophotographic photosensitive drum; a first frame unit supporting the electrophotographic photosensitive drum; a second frame unit supporting the developing roller and swingably connected with the first frame unit; a coupling, mounted to one end portion of the electrophotographic photosensitive drum, for receiving a rotating force for rotating the electrophotographic photosensitive drum from the rotating force applying portion in the state in which the process cartridge is mounted to said main assembly of the apparatus; a first cartridge side portion to be positioned engageable with the first main assembly side positioning portion to regulate movement of the first frame unit in a longitudinal direction of the electrophotographic photosensitive drum in the state in which the process cartridge is mounted to the main assembly of the apparatus; a second cartridge side portion to be positioned which is provided coaxially with an axis of the electrophotographic photosensitive drum at one longitudinal end of the first frame unit and which is engageable with the second main assembly side positioning portion to position the electrophotographic photosensitive drum in a radial direction relative to the main assembly of the apparatus in the state in which the process cartridge is mounted to the main assembly of the apparatus; a third cartridge side portion to be positioned which is provided coaxially with the axis of the electrophotographic photosensitive drum at the other longitudinal end of the first frame unit and which is engageable with the third main assembly side positioning portion to position the electrophotographic photosensitive drum in a radial direction relative to the main assembly of the apparatus in the state in which the process cartridge is mounted to the main assembly of the apparatus; a first unit side regulating portion provided in the first frame unit to regulate movement of the electrophotographic photosensitive drum in the longitudinal direction of said first frame unit; and a first drum side regulating portion provided on the electrophotographic photosensitive drum so as to contact the first unit side regulating portion thereby to regulate movement of the electrophotographic photosensitive drum in the longitudinal direction of the first frame unit.

According to a further aspect of the present invention, there is provided an electrophotographic image forming apparatus including a main assembly of the apparatus to which a process cartridge is detachably mountable, the apparatus comprising, i) a first main assembly side positioning portion;

ii) a second main assembly side positioning portion;

iii) a third main assembly side positioning portion;

iv) a rotating force applying portion;

v) the process cartridge including an electrophotographic photosensitive drum; a drum flange provided at one end of the electrophotographic photosensitive drum, the drum flange including a gear and one end drum shaft; a coupling, mounted to the drum flange, for receiving a rotating force for rotating the electrophotographic photosensitive drum from the rotating force applying portion in the state in which the process cartridge is mounted to the main assembly of the apparatus; a developing roller rotatable by the rotating force received from the rotating force applying portion by the coupling to develop an electrostatic latent image formed on the electrophotographic photosensitive drum; a first frame unit for supporting the one end of the electrophotographic photosensitive drum through a bearing member supporting the one end side drum shaft and for supporting the other of the electrophotographic photosensitive drum through a bearing member supporting the other end side drum shaft; a second frame unit supporting the developing roller and swingably connected with the first frame unit; a first cartridge side portion to be positioned, provided on the bearing member, for engagement with the first main assembly side positioning portion to regulate movement of the first frame unit in a longitudinal direction of the electrophotographic photosensitive drum in the state in which the process cartridge is mounted to the main assembly of the apparatus; a second cartridge side portion to be positioned which is provided coaxially with an axis of the electrophotographic photosensitive drum at one longitudinal end of the first frame unit and which is engageable with the second main assembly side positioning portion to position the electrophotographic photosensitive drum in a radial direction relative to the main assembly of the apparatus in the state in which the process cartridge is mounted to the main assembly of the apparatus; a third cartridge side portion to be positioned which is provided coaxially with the axis of the electrophotographic photosensitive drum at the other longitudinal end of the first frame unit and which is engageable with the third main assembly side positioning portion to position the electrophotographic photosensitive drum in a radial direction relative to the main assembly of the apparatus in the state in which the process cartridge is mounted to the main assembly of the apparatus; a first unit side regulating portion, provided at the one longitudinal end of the first frame unit, for regulating movement of the electrophotographic photosensitive drum in a direction from the one end toward the other end; a second unit side regulating portion, provided on the bearing member, for regulating movement of the electrophotographic photosensitive drum in a direction from the other end toward the one end; and a first unit side regulating portion provided in the first frame unit so as to contact the first unit side regulating portion thereby to regulate movement of the electrophotographic photosensitive drum in the direction from the one end to the other end of the electrophotographic photosensitive drum; and a first drum side regulating portion provided on the electrophotographic photosensitive drum so as to contact the second unit side regulating portion thereby to regulate movement of the electrophotographic photosensitive drum in the from the other end to the one end of the electrophotographic photosensitive drum.

According to the present invention, it is possible to precisely position the coupling of a process cartridge, which is for receiving a rotational force from the main assembly of an electrophotographic image forming apparatus, relative to the rotational force transmitting portion of the main assembly of the apparatus, in terms of the axial line of the rotational force transmitting portion.

Also according to the present invention, it is possible to provide a process cartridge which can be mounted into the main assembly of an electrophotographic image forming apparatus having no mechanism for moving the a rotational member of the apparatus main assembly, that is, the driving force transmitting portion of the apparatus main assembly, which is for transmitting rotational force to the electrophotographic photosensitive drum.

According to the present invention, it is possible to provide a process cartridge, the electrophotographic photosensitive drum of which rotates at a significantly higher level of accuracy than that of a process cartridge which employs nothing but gears to transmit rotational force from the apparatus main assembly to the process cartridge.

According to the present invention, it is possible to provide a process cartridge capable of precisely aligning the axial line of its electrophotographic photosensitive member with the axial line of the counterpart of the main assembly of an electrophotographic image forming apparatus.

Another object of the present invention is to provide a process cartridge capable of precisely aligning the axial line of its coupling with the axial line of the counterpart of the main assembly of an electrophotographic image forming apparatus.

According to the present invention, it is possible to provide an electrophotographic image forming apparatus in which any of the process cartridges described above is removably mountable.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, one of the preferred embodiments of the present invention will be described in detail with reference to the appended drawings. However, the functions, materials, shape of the structural components of the process cartridge and electrophotographic image forming apparatuses, and their positional relationship, are not intended to limit the present invention in scope, unless specifically noted. Further, if a given member of the image forming apparatus, which has been described regarding its material, shape, etc., is mentioned again, it is the same in material and shape, unless specifically noted.

Embodiment (General Structure)

Figure 1:
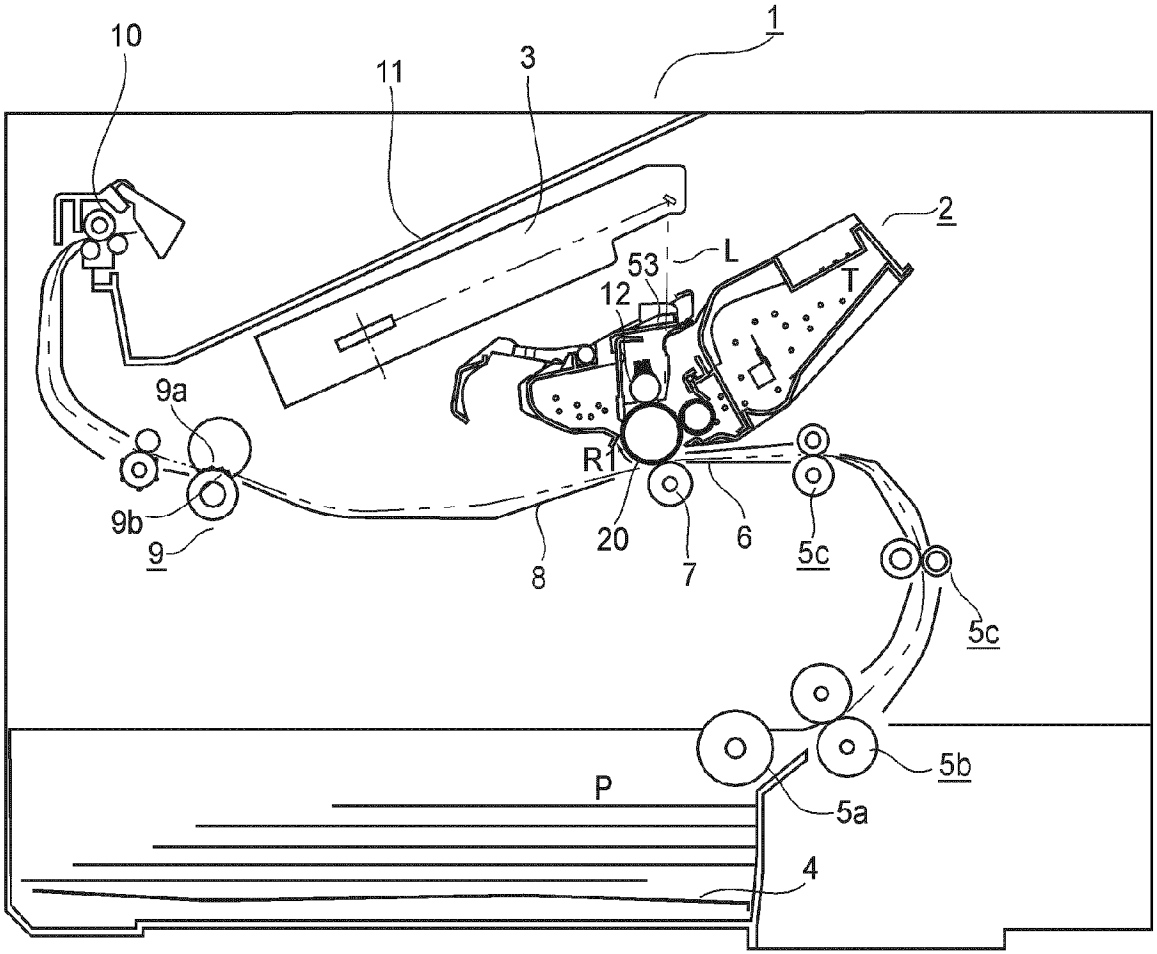
FIG. 1 is a sectional view of the image forming apparatus in the preferred embodiment of the present invention.
Figure 2:
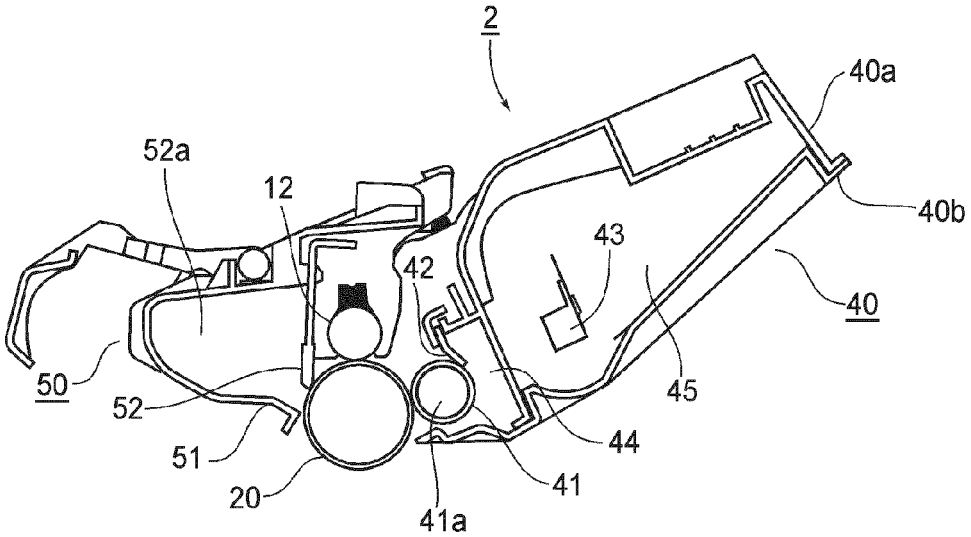
FIG. 2 is an enlarged sectional view of the cartridge in the preferred embodiment.

FIG. 1 is a sectional view of a typical image forming apparatus, in accordance with the present invention, which is made up of the image forming apparatus main assembly 1 (which hereafter may be referred to simply as apparatus main assembly 1), and a process cartridge 2 (which hereafter may be referred to simply as cartridge 2). FIG. 2 is an enlarged sectional view of the cartridge 2. Next, referring to FIGS. 1 and 2, the general structure and image forming process of the image forming apparatus in this embodiment will be described.

This image forming apparatus is a laser beam printer based on an electrophotographic technology. It employs the process cartridge 2, which is removably mountable in the main assembly 1. The apparatus main assembly 1 is provided with an exposing apparatus 3 (laser scanner unit) and a sheet tray 4. The exposing apparatus 3 is located above the space for the cartridge 2. The sheet tray 4 is located below the space for the cartridge 2, and stores multiple sheets of recording medium P, which are the sheets of recording medium on which an image is formed. The apparatus main assembly 1 is also provided with a pickup roller 5*a*, a pair of recording medium conveyance rollers 5*b*, a pair of recording medium conveyance rollers 5*c*, a transfer guide 6, a transfer charge roller 7, a recording medium conveyance guide 8, a fixing apparatus 9, a pair of recording medium discharge rollers 10, a delivery tray 11, etc., listing from the upstream side in terms of the direction in which the sheets P are conveyed.

(Image Formation Process)

Next, the image formation process used by the image forming apparatus in the following preferred embodiment of the present invention will be described. The electrophotographic photosensitive drum 20 (which hereafter will be referred to as drum) is rotationally driven in the direction indicated by an arrow mark R1, at a preset peripheral velocity (process speed), in response to a print start signal. The peripheral surface of the drum 20 is in contact with a charge roller 12, to which bias voltage is being applied. Thus, the peripheral surface of the drum 20 is uniformly changed by the charge roller 12.

The exposing apparatus 3 outputs a beam L of laser light while modulating the beam L of with sequential electrical digital picture element signals which reflect the information of the image to be formed. More specifically, the exposing apparatus 3 projects the beam L of laser light in such a manner that the beam L enters the cartridge 2 through the exposure window of the top wall of the cartridge 2, and scans the peripheral surface of the drum 20. As a result, an electrostatic latent image, which reflects the abovementioned information of the image, is formed on the peripheral surface of the drum 20. This electrostatic latent image is developed by the developer T (which hereafter will be referred to as toner) in the second unit 40, into a visible image, that is, an image formed of toner (which hereafter will be referred to as toner image).

To describe in more detail, the charge roller 12 is positioned so that its peripheral surface is in contact with the peripheral surface of the drum 20 to charge the drum 20. The charge roller 12 is rotated by the rotation of the drum 20. The second unit 40 of the cartridge 2 supplies the portion of the peripheral surface of the drum 20, which is in the development area, with toner to develop the latent image formed on the peripheral surface of the drum 20.

The abovementioned second unit 40 has a toner chamber 45, a stirring member 43, a toner supplying chamber 44, a development roller 41, a magnetic roller 41*a* (stationary magnet), and a development blade 42. The magnetic roller 41*a* is in the hollow of the development roller 41, which is a developer bearing member. The second unit 40 sends the toner T in the toner chamber 45 into the toner supplying chamber 44 by the rotation of the stirring member 43, while rotating the development roller 41. As the development roller 41 is rotated, a layer of toner, which is of a preset thickness, is formed on the peripheral surface of the development roller 41 while being frictionally charged, by the development blade 42. Then, the second unit 40 transfers the toner particles in the toner layer on the development roller 41 onto the numerous exposed points of the latent image on the drum 20 to develop the latent image into a visible image, or a toner image. The development blade 42 is a blade for regulating the amount of toner that is allowed to remain coated per unit area of the peripheral surface of the drum 20, and also, for frictionally charging the toner (for giving triboelectric charge to toner).

Meanwhile, in synchronism with the timing with which the beam L of laser light is outputted, the sheet P is conveyed to the transfer area, which is the interface between the drum 20 and transfer charge roller 7, by way of the transfer guide 6, so that the toner image on the drum 20 arrives at the transfer area at the same time as the sheet P. In the transfer area, the toner image on the peripheral surface of the drum 20 is transferred onto the sheet P as if it were peeled away from the peripheral surface of the drum 20.

After the transfer of the toner image onto the sheet P, the sheet P is separated from the drum 20, and is conveyed to the fixing apparatus 9 along the recording medium conveyance guide 8. Then, the sheet P is conveyed through the nip between the fixation roller 9*a* and a pressure roller 9*b*, which make up the fixing apparatus 9. While the sheet P is conveyed through the nip, the sheet P and the toner image thereon are subjected to pressure and heat. As a result, the toner image becomes fixed to the sheet P. After the fixation of the toner image to the sheet P, the sheet P is conveyed to the pair of discharge rollers 10, and is discharged into the delivery tray 11.

Meanwhile, the drum 20, from which the toner image has just been transferred, is cleared of the transfer residual toner, that is, the toner remaining on the peripheral surface of the drum 20 after the toner image transfer, to be used for the next image forming process, which begins with the charging of the drum 20. The toner removed from the drum 20, that is, the waste toner, is stored in a waste toner chamber 52*a*.

The charge roller 12, the development roller 41, the cleaning blade 52, etc., which were mentioned in the description of the image formation process given above, are the process means for processing the drum 20.

(Structure of Process Cartridge Frame)

Figure 3:
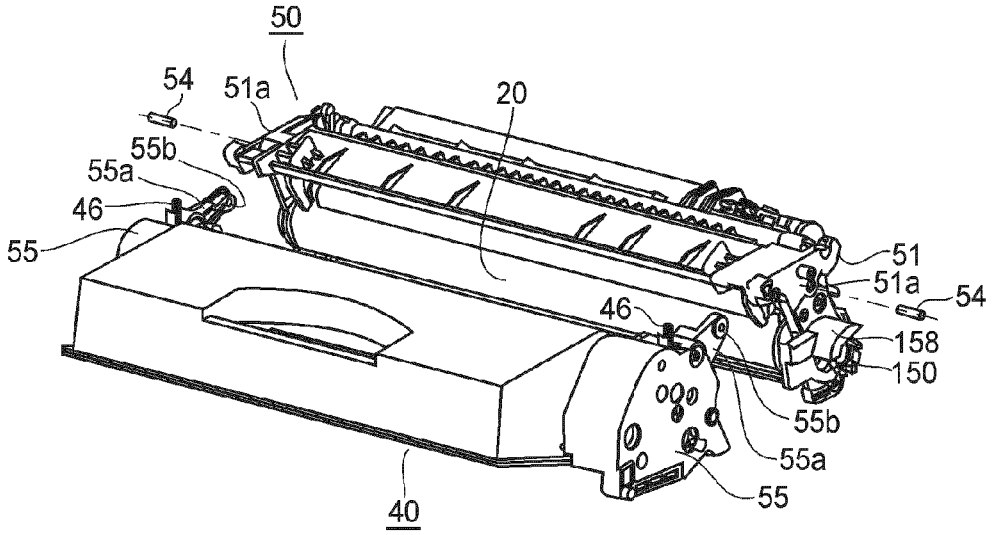
FIG. 3 a perspective view of the process cartridge, showing the frame structure of the cartridge.

FIG. 3 is a perspective view of the process cartridge 2, and shows the structure of the cartridge frame. Next, the frame structure of the process cartridge 2 will be described with reference to FIGS. 2 and 3.

Referring to FIG. 2, the drum 20, the charge roller 12, and the cleaning blade 52 are integrally attached to the drum supporting portion 51 of the frame of the cartridge 2, making up a first unit 50 of the cartridge 2.

A second unit 40 of the cartridge 2 is made up of: the toner storage container 40*a* having the toner storage chamber 45 for storing toner and toner supply changer 44; and the lid 40*b*. The toner storage container 40*a* and the lid 40*b* are joined to each other by welding or the like means.

Next, referring to FIG. 3, the first unit 50 and second unit 40 are connected to each other with the use of a pair of connecting members 54, such as a pair of round connective pins, so that they can be rotationally moved relative to each other about the pair of connecting members 54.

That is, referring to FIG. 3, the cartridge 2 is provided with a pair of side covers 55, which are located at the lengthwise ends of the unit 40 (in terms of a direction parallel to axial line of development roller 41). Each side cover 55 is provided with an arm portion 55*a*, the tip portion of which is provided with a hole 55*b*, the axial line of which is parallel to the development roller 41. The drum supporting portion 51 of the frame of the first unit 50 is provided with a hole 51*a*, which aligns with the hole 55*b* of the second unit 40 as the arm portion 55*a* is inserted into a preset portion of the drum supporting portion 51 (hole 55*b* on left side is not shown in FIG. 3). Inserting the connective members 54 into the holes 55*b* and 51*a* on the left side of the cartridge 2, and the holes 55*b* and 51*a* on the right side of the cartridge 2 connects the first and second units 50 and 40 in such a manner that the two units 50 and 40 are rotationally movable relative to each other about the pair of connective members. Further, the cartridge 2 is provided with a pair of compression springs 46, which are attached to the base portion of the abovementioned arm portions 55*a*, one for one, so that they contact the drum supporting portions 51 to keep the second unit 40 pressed downward, ensuring that the development roller 41 (FIG. 3) is kept pressured toward the drum 20. Further, the lengthwise end portions of the development roller 41 are fitted with a pair of spacers (unshown), one for one, ensuring that a preset amount of gap is maintained between the peripheral surface of the development roller 41 and that of the drum 20.

One of the lengthwise ends of the first unit 50 is provided with a coupling 150, through which a driving force is transmitted from the apparatus main assembly 1 to the cartridge 2 to rotate the drum 20. Incidentally, hereafter, the lengthwise end of the cartridge 2, in terms of the direction parallel to the lengthwise direction of the drum 20, which has the coupler 150, will be referred to as the driving force receiving end (side), whereas the opposite lengthwise end of the cartridge 2 from the driving force receiving end (side) may be referred to simply as the opposite end (side).

(Method for Transmitting Rotational Force to Process Cartridge)

Figure 4:
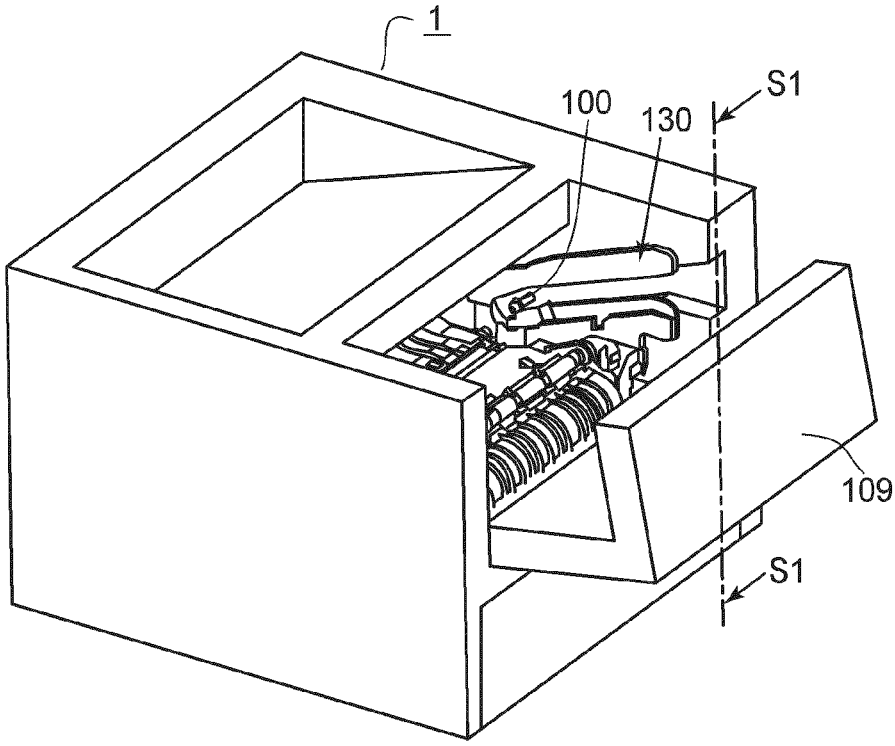
FIG. 4 is a perspective view of the main assembly of the image forming apparatus.

FIG. 4 is a perspective view of the apparatus main assembly 1, the cartridge insertion (removal) door 109 (main assembly cover, main assembly door), which is open to show the interior of the apparatus main assembly 1. The apparatus main assembly 1 shown in FIG. 4 is not holding any process cartridge 2. Next, referring to FIG. 4, the method for transmitting the rotational force to the cartridge 2 will be described.

Referring to FIG. 4, the apparatus main assembly 1 is provided with a cartridge mounting means 130 for mounting or dismounting the cartridge 2. Thus, the cartridge 2 is mounted into the apparatus main assembly 1 following the cartridge mounting means 130 (which hereafter may be referred to simply as mounting means). As the cartridge 2 is mounted into the apparatus main assembly 1, the cartridge driving shaft 100 (which hereafter will be referred to simply as drive shaft 100) of the apparatus main assembly 1 engages with the coupling member 150 (which hereafter will be referred to as coupling, FIG. 3), enabling the drum 20 to rotate by receiving a rotational force from the apparatus main assembly 1.

1) Drive Shaft 100

Figure 5:
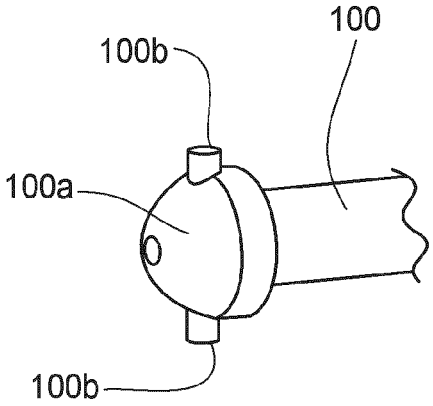
FIG. 5 is a perspective view of the cartridge driving shaft of the apparatus main assembly.

FIG. 5 is a perspective view of the drive shaft 100 of the apparatus main assembly 1. The drive shaft 100 is in connection with an unshown driving force transmitting means, such as a gear train, with which the apparatus main assembly 1 is provided, and which is connected to a motor. The end portion 100*a* of the drive shaft 100 is semispherical, and is provided with a rotational force transmission pin 100*b*.

2) Coupling 150

Figure 6:
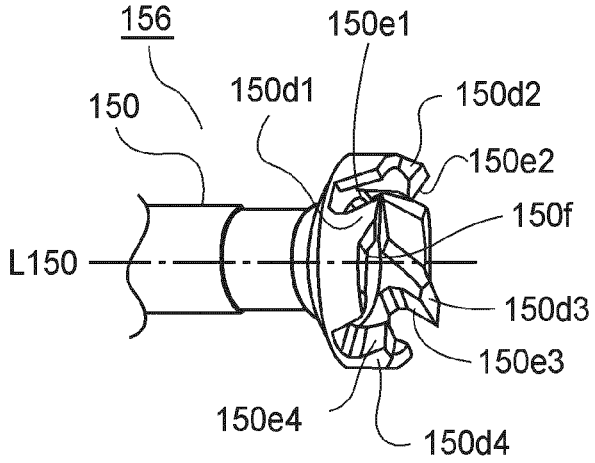
FIG. 6 is a perspective view of the coupling of the process cartridge.

FIG. 6 is a perspective view of the coupling 150. The material of which the coupling 150 is formed is a resin, such as, polyacetal, polycarbonate, and PPS. However, in order to increase the coupling 150 in rigidity, glass fiber, carbon fiber, or the like, may be mixed into the above described material for the coupling 150, by an amount proportional to the amount of the torque to which the coupling 150 will be subjected. Further, a piece or pieces of metal may be inserted into the coupling 150 to increase the coupling 150 in rigidity. Further, the entirety of the coupling 150 may be formed of a metallic substance to ensure that the coupling 150 is satisfactorily rigid.

The end of the coupling 150 is provided with multiple (four in this embodiment) driving force catching projections 150*d* (150*d*1-150*d*4), by which the driving force from the drive shaft 100 is caught (received). Each of the driving force catching projections 150*d* (150*d*1-150*d*4) is provided with a rotational force catching portion 150*e* (150*e*1-150*e*4), the driving force catching surface of which is angled relative to the axial line L150 of the coupling 150. Further, the coupling 150 is provided with a conic recess 150*f*, which is on the inward side of the driving force catching projections 150*d*1-150*d*4 in terms of the radius direction of the coupling 150.

3) Engagement Between Drive Shaft 100 and Coupling 150

Figure 7:
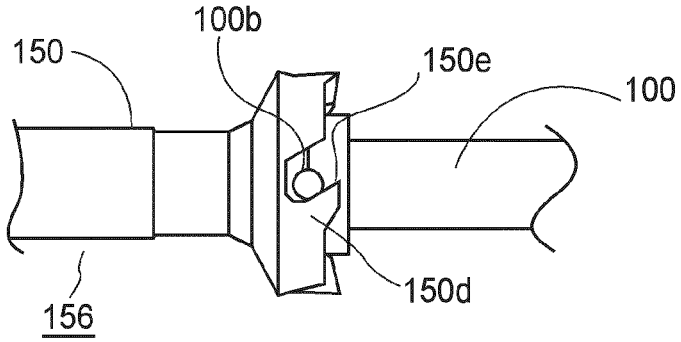
FIG. 7 is a side view of the coupling and cartridge driving shaft when they are in engagement with each other.
Figure 8:
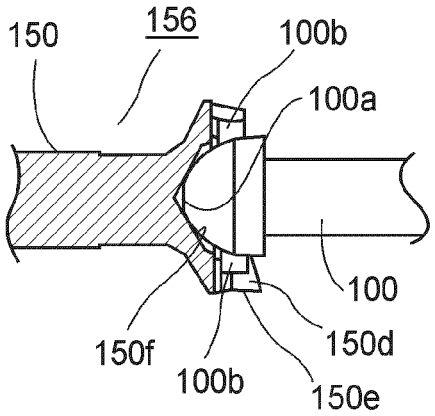
FIG. 8 is a sectional view of the coupling and cartridge driving shaft when they are in engagement with each other.

FIG. 7 is a side view of the coupling 150 and driving shaft 100, which are in engagement with each other. FIG. 8 is a sectional view of the coupling 150 and driving shaft 100, at the plane which coincides with both the axial line of the coupling 150 and the axial line of the drive shaft 100. Next, referring to FIGS. 7 and 8, the engagement of the drive shaft 100 and coupling 150 will be described.

The rotational force transmission pin 100*b* of the drive shaft 100 is in engagement with the rotational force catching portions 150*e* (150*e*1-150*e*4) of the coupling 150. Although not shown in FIG. 7, the portion of the rotational force transmission pin 100*b*, which is on the back side of the drawing, is in engagement with another rotational force catching portion 150*e*, which is also on the back side of the drawing. Further, the end portion 100*a* of the drive shaft 100 is in contact with the surface of the conic recess 150*f* of the coupling 150. Thus, as the drive shaft 100 rotates, a driving force is transmitted to the rotational force catching portions 150*e* from the rotational force transmitting pin 100*b*. Further, each driving force catching portion 150*e* is angled relative to the axial line L150 of the coupling 150. Therefore, as the drive shaft 100 rotates, the coupling 150 and drive shaft 100 pull each other, ensuring that the end 100*a* of the drive shaft 100 comes into contact, and remains in contact, with the surface of the conic recess 150*f* so that the driving force is reliably transmitted from the drive shaft 100 to the coupling 150.

As described above, the coupling 150 is attached to one of the lengthwise ends of the drum 20. It receives the rotational force for rotating the drum 20 from the apparatus main assembly 1 while the cartridge 20 is in its proper position and attitude for image formation, in the apparatus main assembly 1.

4) Connective Components for Coupling 150

Figure 9:
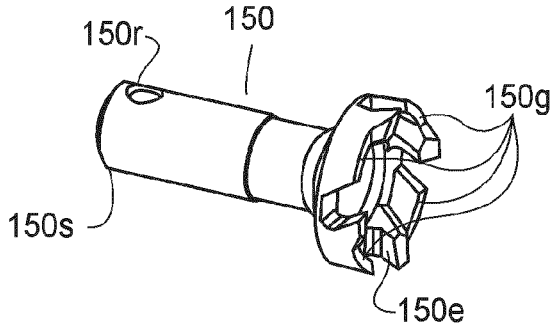
FIG. 9 is a perspective view of the coupling.
Figure 10:
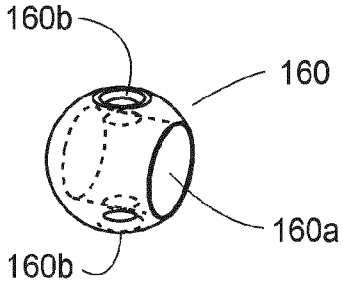
FIG. 10 is a perspective view of the spherical member.
Figure 11:
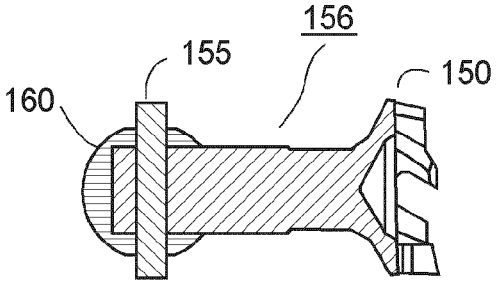
FIG. 11 is a sectional view of the coupling, the spherical member, and the connective pin after they were put together.
Figure 12:
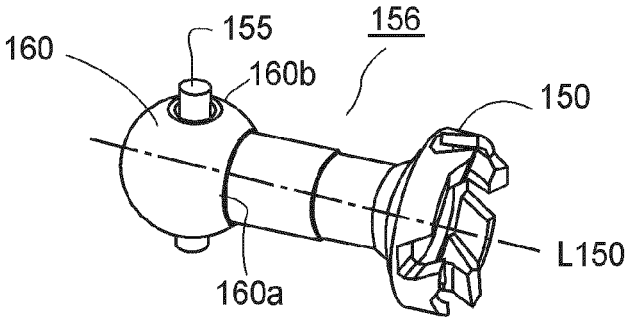
FIG. 12 is a perspective view of the coupling, the spherical member, and the connective pin after they were put together.

FIG. 9 is a perspective view of the coupling 150, and FIG. 10 is a perspective view of the spherical member 160. FIG. 11 is a sectional view of the coupling 150 and the connective components for the coupling. FIG. 12 is a perspective view of the coupling 150 and the connective components therefor.

Referring to FIG. 9, the coupling 150 has a through hole 150*r*, which is in the opposite end 150*s* of the coupling 150 from the end having the rotational force receiving portions 150*e*. Next, referring to FIG. 10, the abovementioned opposite end portion 150*s* of the coupling 150 is fitted with a spherical member 160, which is roughly spherical. The spherical member 160 is provided with a blind hole 160*a*, and a through hole 160*b*. The blind hole 160*a* is the hole into which the end portion 150*s* of the coupling 150 is inserted. The through hole 160*b* is the hole, through which a pin 155 (rotational force transmitting portion) is put in such a manner that it goes through the abovementioned hole 150*r* of the coupling 150. The through hole 160*b* intersects the blind hole 160*a*. The pin 155 will be described later in more detail.

Figure 13:
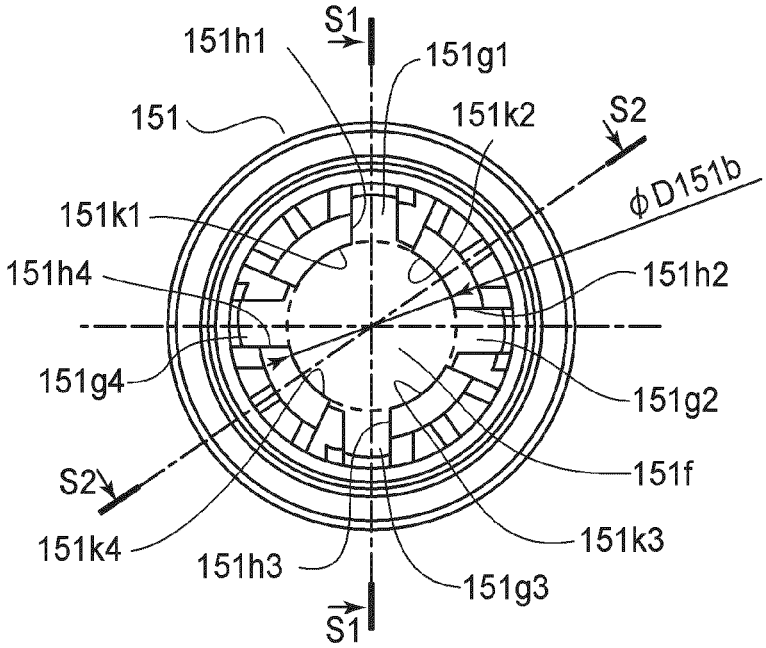
FIG. 13 is a plan view of the drum flange.

Referring to FIGS. 12 and 13, the end portion 150*s* of the coupling 150 is inserted into the blind hole 160*a* of the spherical member 160, and the pin 155 is put through the through hole 160*b*, with the through hole 160*b* being aligned with the through hole 150*r* of the coupling 150. In this embodiment, the coupling 150, the spherical member 160, and the pin 155 are designed so that the coupling 150 loosely fits in the blind hole 160*a*; the pin 155 loosely fits in the through hole 150*r*, while fitting tightly in the through hole 160*b*. Thus, after the fitting of the pin 155 into the through hole 160*b*, the pin 155 and the spherical member 160 are virtually integral with each other. This state of engagement hereafter will be referred to as the "universal coupling" after a universal joint. Receiving a driving force from the drive shaft 100, the coupling 150 rotates about its axial line L150, causing the wall of the through hole 150*r* to come, and remain, in contact with the pin 155. Thus, the rotational force from the apparatus main assembly 1 is turned into the rotational force, which rotates the pin 155 about the rotational axis L150 of the coupling 150.

5) Transmission of Rotational Force to Drum 20 Through "Universal Coupling"

Figure 14:
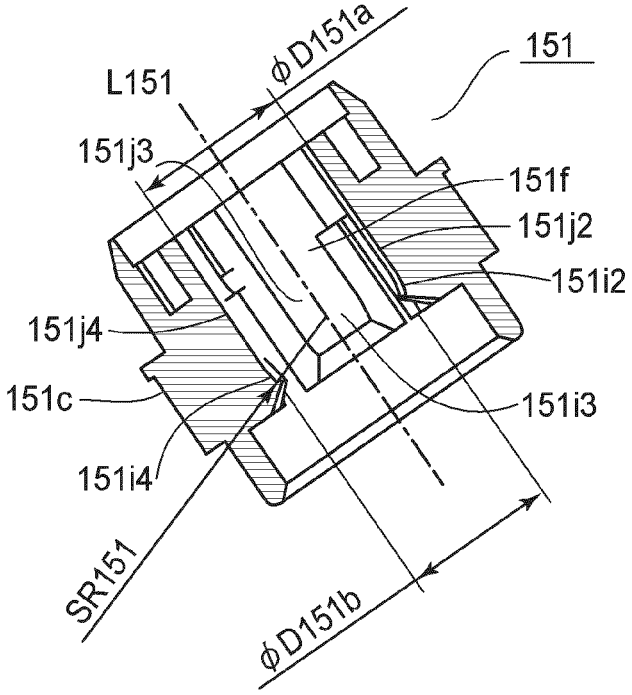
FIG. 14 is a sectional view of the drum flange, at the plane S2-S2 in FIG. 13.
Figure 15:
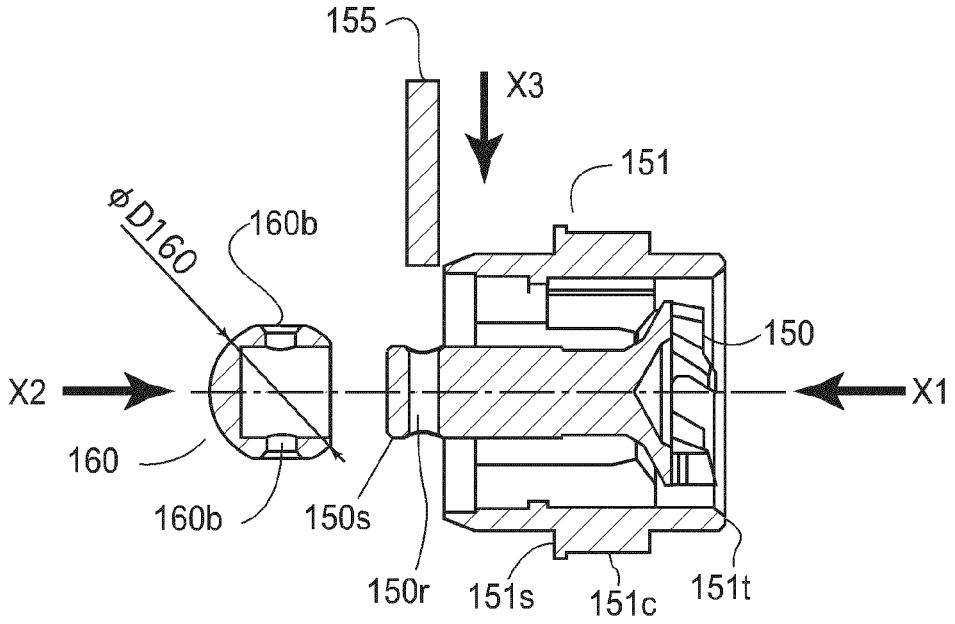
FIG. 15 is a sectional view of the coupling, the spherical member, the drum flange, and the connective pin, at the plane S1-S1 in FIG. 13, before they are put together, showing the steps for attaching the coupling to the drum flange.
Figure 16:
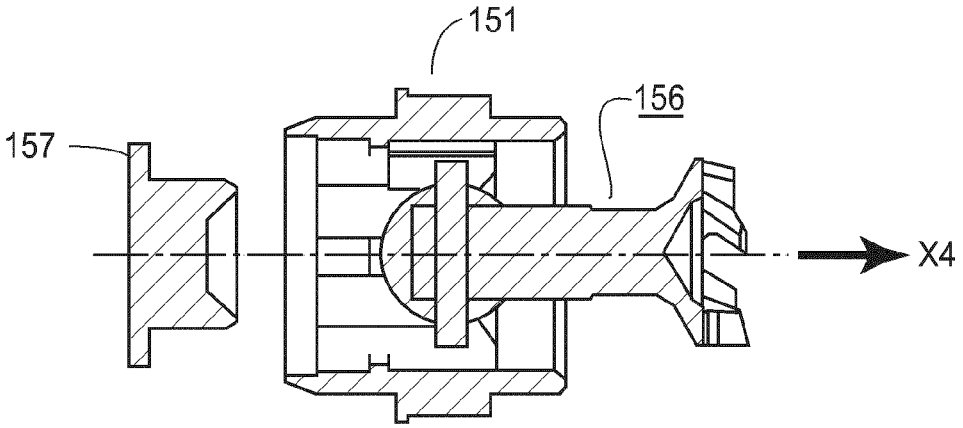
FIG. 16 a sectional view of the combination of the coupling disengagement prevention plug, the coupling, the spherical member, drum flange, and the connective pin, at the plane S1-S1 in FIG. 13, showing the steps for securely attaching the coupling to the drum flange.
Figure 17:
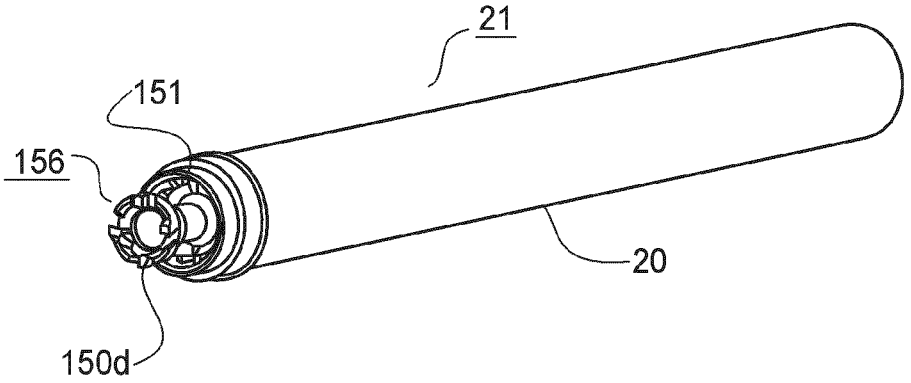
FIG. 17 is a perspective view of the photosensitive drum unit, as seen from the its driving force receiving side.
Figure 18:
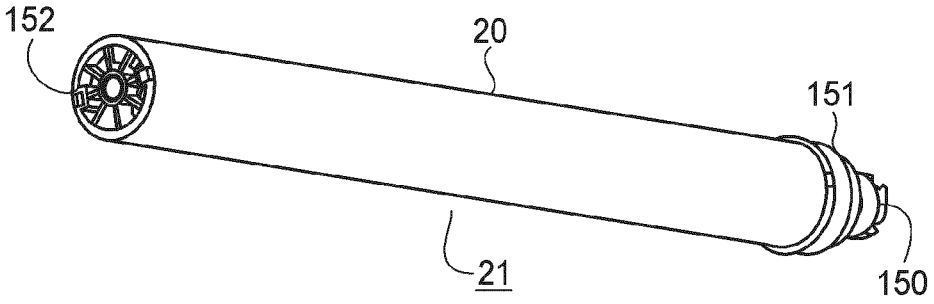
FIG. 18 is a perspective view of the photosensitive drum unit, as seen from the opposite side from its driving force receiving side.

FIG. 13 is a schematic drawing of a drum flange 151 (which hereafter may be referred to simply as flange 151), which is for describing the flange 151. FIG. 14 is a sectional view of the flange 151, at a plane S2-S2 in FIG. 13. FIG. 15 is a schematic sectional view of the spherical member 160, the coupling 150, and the flange 151, at a plane S1-S1 in FIG. 13, which is for describing the method of securely attaching the coupling 150 to flange 151. FIG. 16 is a schematic sectional view of the spherical member 160, the coupling 150, and the flange 151, at a plane S1-S1 in FIG. 13, which is for describing the method of fixing the coupling 150 to the flange 151. FIG. 17 is a perspective view of the photosensitive drum unit 21, as seen from the driving force receiving side (side having coupling 150), which is for describing the photosensitive drum unit 21. FIG. 18 is a perspective view of the photosensitive drum unit 21, as seen from the opposite side from the driving force receiving side (opposite side from coupling 150), which is also for describing the photosensitive drum unit 21.

Referring to FIGS. 13 and 14, an example of the flange 151 to which the coupling 150 is attached will be described. FIG. 13 is a plan view of the flange 151, as seen from the drive shaft side. Designated by reference codes 151*g* (151*g*1-151*g*4) in FIG. 13 are four slots with which the flange 151 is provided. The depth direction of each slot 151*g* is parallel to the axial line of the flange 151. When the coupling 150 is attached to the flange 151, the pin 155 is put through the combination of the slots 151*g*1 and 151*g*3, or the combination of the slots 151*g*2 and 151*g*4. Further, the upstream wall of each of the slots 151*g*, in terms of the clockwise direction, functions as a rotational force transmission or catching surface (rotational force catching surface) 151*h* (151*h*1-151*h*4). When the driving force is transmitted to the flange 151 from the pin 151, the pin 155 comes into contact with the rotational force catching surface 151*h*. Further, the center portion of the flange 151, that is, the portion of the flange 151, which is adjacent to the axial line of the flange 151, is hollow (flange 151 is provided with recess 151*f*).

The recess 151*f* is the space surrounded by the arcuate walls 151*j* (151*j*1-151*j*4), disengagement preventing portions 151*i* (151*i*1-151*i*4), and openings 151*k* (151*k*1-151*k*4). The arcuate walls (surfaces) 151*j* (151*j*1-151*j*4) coincide with a hypothetical cylindrical wall (surface) 151*a*, which is the same in curvature as the arcuate walls 151*j*, and the axial line of which coincides with the axial line L151 of the flange 151. The diameter ϕ of the hypothetical cylindrical wall (surface) 151*a* is D151*a*. Each of the disengagement preventing portions 151*i* (151*i*1-151*i*4) is also a roughly arcuate portion as the arcuate wall 151*j*, and smoothly extends from the arcuate wall 151*j*. That is, the disengagement preventing portions 151*i* coincide with a hypothetical cylindrical wall which is SR151 in radius. Each of the openings 151*k* (151*k*1-151*k*2) is on the drive shaft side of the disengagement preventing portion 151*i*, and its curvature is the same as the curvature of a circle which is D151*b* in diameter ϕ.

The relationship among the external dimension (diameter ϕ) D160 of the spherical member 160, and the measurements of the abovementioned portions of the flange 151 (FIGS. 14 and 15), is as follows:

$$\phi D262b<\phi D160<\phi D151a<2\times SR151.$$

The spherical member 160 can be inserted into the recess 151*f*, with the presence of a gap G. However, while the spherical member 160 is in the recess 151*f*, it is not allowed to move toward the opening 151*k*, in terms of the direction parallel to the axial line L151. Therefore, it does not occur that the spherical member 160 becomes disengaged from the flange 151 under the normal condition after the fitting of the spherical member 160 into the flange 151.

Next, referring to FIGS. 15 and 16, the process of inserting the coupling 150 into the flange 151, and fixing the coupling 150 to the flange 151, will be described. First, the end portion 150*s* is to be inserted into the flange 151 from the direction indicated by an arrow mark X1. Then, the end portion 150*s* is to be fitted with the spherical member 160 in a manner to cover the end portion 150*s* from the direction indicated by an arrow mark X2. Next, the spherical member 160 is to be positioned relative to the end portion 150*s* so that its through hole 160*b* aligns with the through hole 150*r* of the end portion of the 150*s*. Then, the pin 151 is to be inserted from the direction indicated by an arrow mark X3 so that the pin 151 extends from one end of the through hole 160*b* and the other, through the through hole 150*r*. The through holes 160*b* and 150*r*, and the pin 150, are designed so that the hole 160*b* is smaller in diameter than the pin 155. Therefore, there is a certain amount of friction between the pin 151 and the wall of the through hole 160*b* when the pin 151 is inserted. Incidentally, in this embodiment, the amount of difference between the diameter of the pin 151 and that of the through hole 160*b* is set to roughly 50 μm.

Therefore, it does not occur that the pin 155 becomes disengaged from the spherical member 160 under the normal condition. That is, it is ensured that the coupling 150 remains engaged with the flange 151.

Then, the combination 156 ("universal coupling") of the spherical member 160 and coupling 150 is to be moved in the direction indicated by an arrow mark X4 to place the spherical member 160 in contact with, or close to, the disengagement prevention portion 151*i*.

Next, the disengagement preventing member 157 is to be inserted in the direction indicated by the arrow mark X4 to solidly attach the disengagement preventing member 157 to the flange 151. There remains a gap (play) between the disengagement preventing member 157 and spherical member 160 after the attachment of the disengagement preventing member 157. Therefore, the coupling 150 is allowed to change in attitude.

Next, referring to FIGS. 17 and 18, the structure of the photosensitive drum unit 21 will be described. After the combination 156 ("universal coupling") is attached to the flange 151, the flange 151 is to be solidly attached to one of the lengthwise ends of the drum 20 in such a manner that the driving force receiving projections 150*d* of the coupling 150 are exposed from the flange 151. Further, the drum flange 152 is to be solidly attached to the opposite end of the drum 200 from the driving force receiving end. As for the method for solidly attaching the drum flanges 151 and 152 to the drum 20, crimping, bonding, welding, or the like, may be used.

Next, referring to FIGS. 19-22, the structural arrangement for supporting the photosensitive drum unit 21 will be described. The flange 151 attached to the driving force receiving end of the photosensitive drum unit 21 has a drum gear 151*c* and a shaft 151*v*. The drum gear 151*c* is the gear for transmitting the rotational force, which the flange 151 received, to the development gear 41*b* of the development roller 41. The shaft 151*v* functions as one of the drum shafts. The shaft 151*v* is rotatably supported by the supporting portion 158*d* of the bearing 158. The gear 151*c* is an integral part of the flange 151. Referring to FIG. 22, the opposite end of the photosensitive drum unit 21 from the shaft 151*v* is provided with a drum shaft 202, by which the drum 20 is supported. The drum shaft 202 is solidly attached to the drum supporting portion 51 of the cartridge 2 by press-fitting or the like method. Thus, the photosensitive drum unit 21 is rotatably supported by the drum shaft 202 fitted in the hole 152*a* of the drum flange 152 on the opposite side of the photosensitive drum unit 21 from the driving force receiving side.

The drum gear 151*c* is a helical gear, the teeth of which are tilted in such a direction that as the driving force is transmitted to the drum gear 151*c*, the drum gear 151*c* is thrust toward the direction opposite from the gear 151*c*. Incidentally, the lengthwise direction (axial line) of the drum 20 is parallel to the lengthwise direction of the cartridge 2.

The gear 151*c* transmits the rotational force, which the coupling 150 received from the drive shaft 100, to the development roller 41 through the development gear 41*b*, rotating thereby the development roller 41.

As described above, the drive shaft 100 is rotated by the rotational force transmitted thereto from the motor (unshown) of the apparatus main assembly 1 through the driving force transmitting means (unshown), such as the gears of the apparatus main assembly 1. Then, the rotational force is transmitted to the cartridge 2 through the coupling 150. Then, the driving force is transmitted from the coupling 150 to the flange 151 through the pin 155. As a result, the driving force is transmitted to the drum 20, to which the flange 151 is integrally attached.

(Structure Arrangement for Mounting or Dismounting Cartridge)

Figure 23:
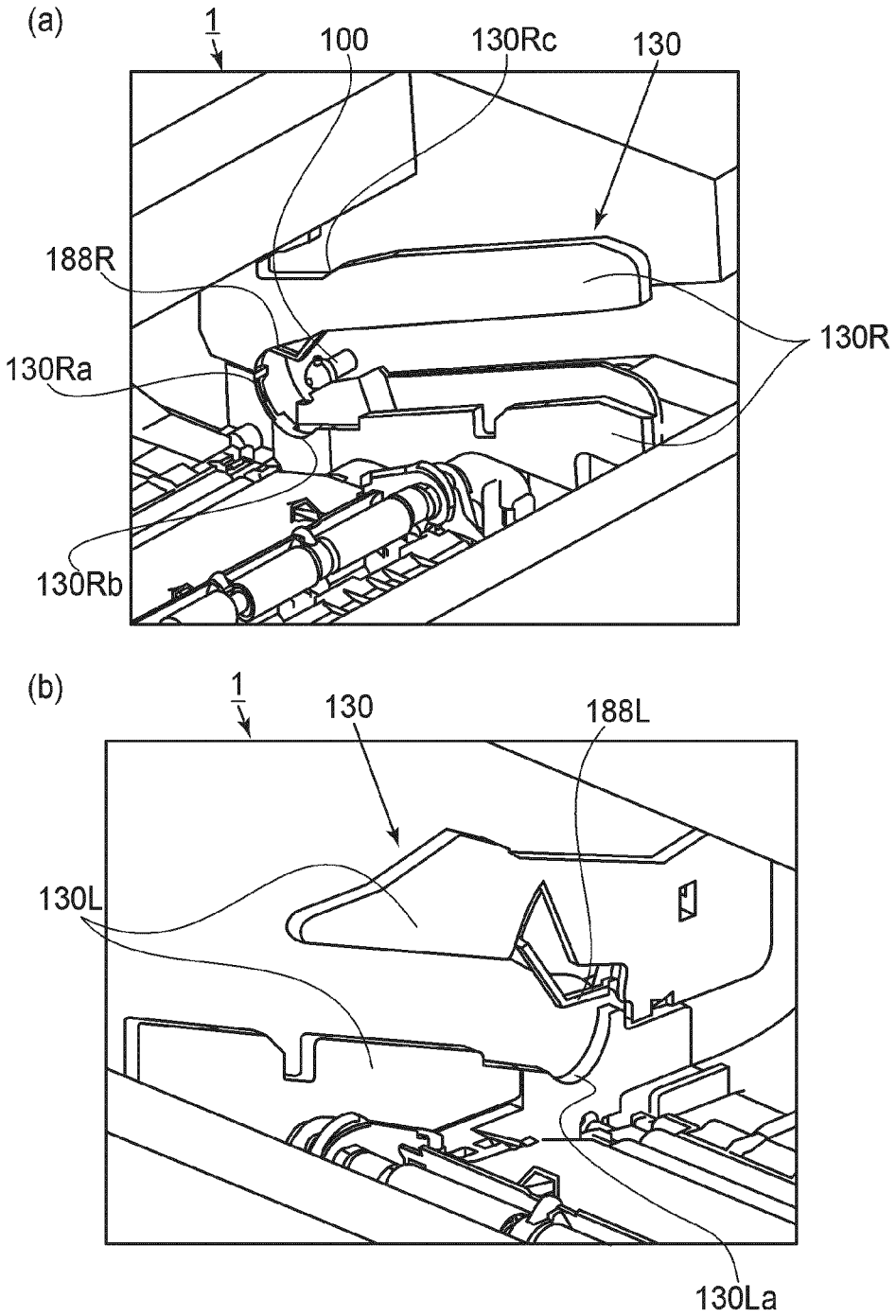
FIGS. 23(*a*) and 23(*b*) are perspective views of the cartridge guiding rails of the apparatus main assembly, on the driving force transmitting side and the opposite side from the driving force transmitting side, respectively.

Next, the structural arrangement for allowing the cartridge 2 to be removably mounted in the apparatus main assembly 1 will be described. Referring to FIGS. 23(*a*) and 23(*b*), the cartridge mounting means 130 of the apparatus main assembly 1 in this embodiment has a pair of guides 130R and 130L, which are located on the left and right ends, respectively, of the cartridge space in the apparatus main assembly 1, facing each other across the cartridge space. FIG. 23(*a*) corresponds to the driving force receiving side of the cartridge 2, and FIG. 23(*b*) corresponds to the opposite side of the cartridge 2 from the driving force receiving side. It is along these guides 130R and 103L that the cartridge 2 (unshown in FIG. 23) is mounted or dismounted. Incidentally, in order to mount the cartridge 2 into the apparatus main assembly 1, the door 109 (FIG. 4) of the apparatus main assembly 1 must be opened. The door 109 is to be closed after the mounting of the cartridge 2. The closing of the door 109 concludes the process of mounting the cartridge 2 into the apparatus main assembly 1. Also incidentally, the door 109 has to be opened also in order to remove the cartridge 2 from the apparatus main assembly 1. These processes are to be carried out by a user (operator).

Figure 19:
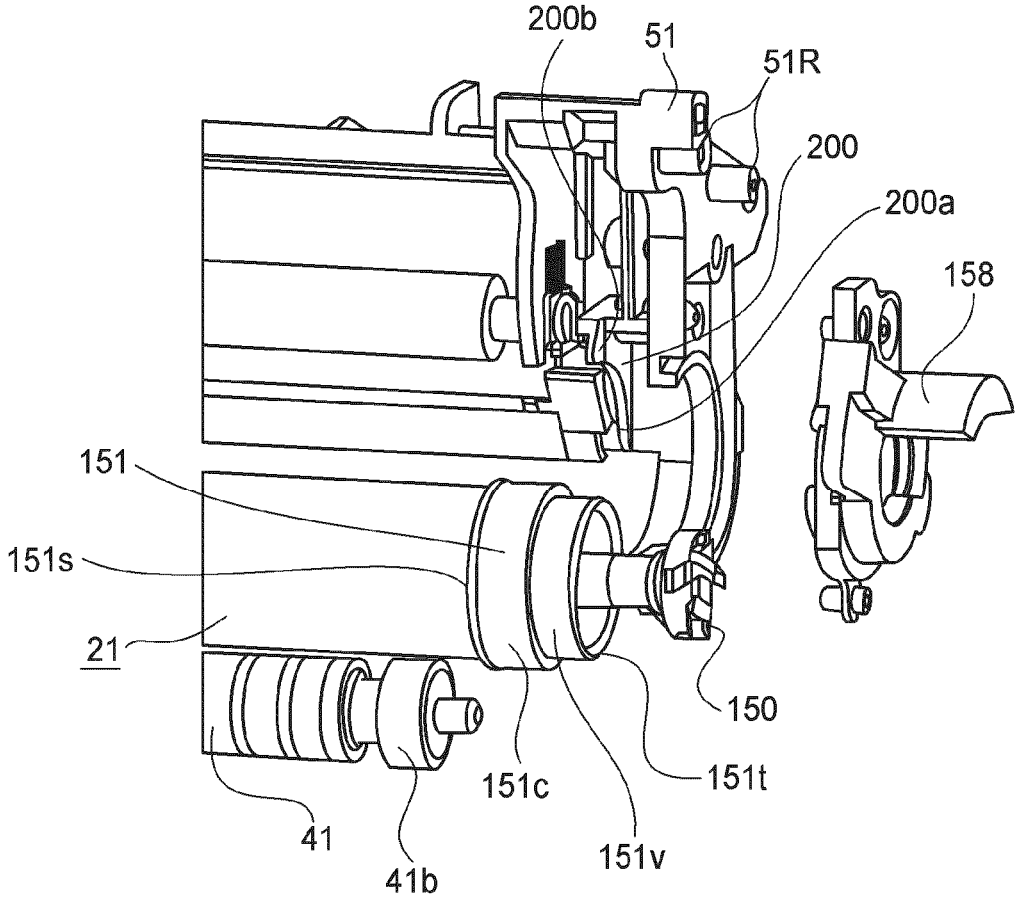
FIG. 19 is a perspective view of the end portion of the photosensitive drum unit, and its adjacencies, on the driving force receiving side of the drum unit, showing the structural arrangement for supporting the end portion.
Figure 21:
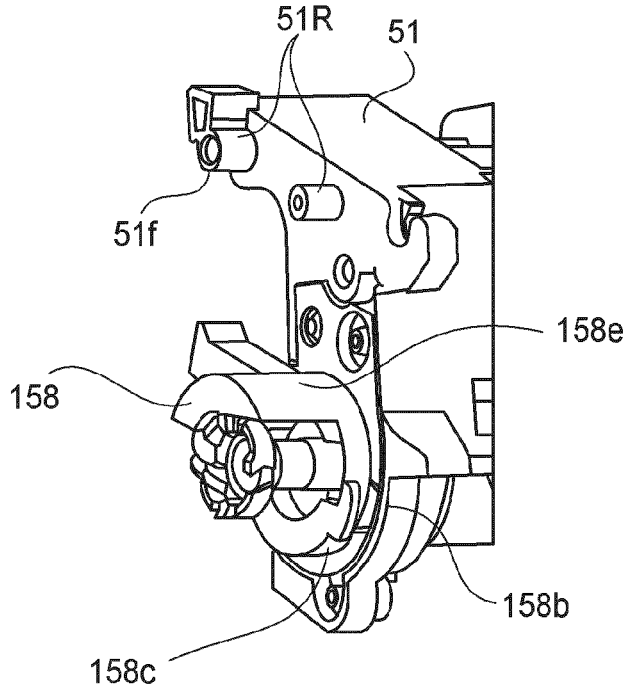
FIG. 21 is another perspective view of the force receiving end portion of the photosensitive drum unit, and its adjacencies, showing the structural arrangement for supporting the driving force receiving end of the photosensitive drum unit.
Figure 22:
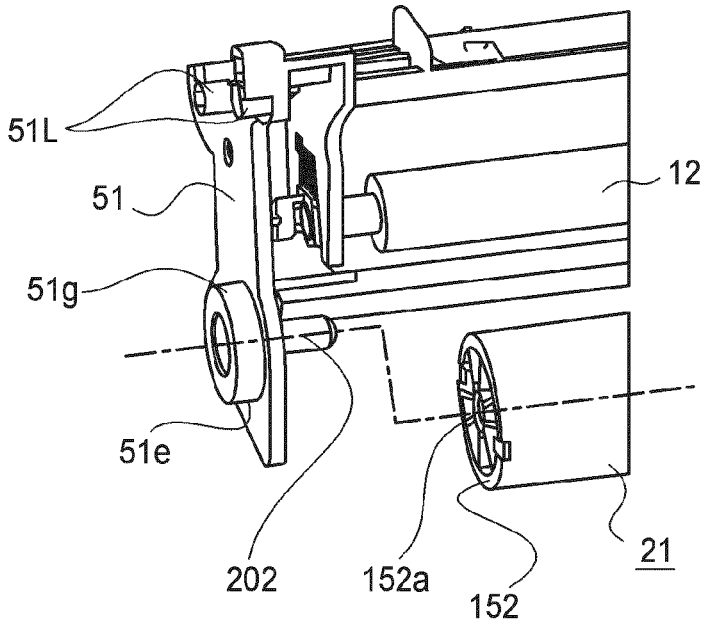
FIG. 22 is a perspective view of the opposite end portion of the photosensitive drum unit from the driving force receiving end, and its adjacencies, showing the structural arrangement for supporting the opposite end portion of the photosensitive drum unit.

Referring to FIGS. 19 and 21, the driving force receiving end of the first unit 50 of the cartridge 2 is provided with a pair of cartridge guides 51R, which project outward of the cartridge 2 in the direction parallel to the lengthwise direction of the cartridge 2, whereas the opposite end the first unit 50 of the cartridge 2 is provided with a pair of cartridge guides 51L, as shown in FIG. 22.

When the cartridge 2 is mounted into, or dismounted from, the apparatus main assembly 1, the cartridge guides 51R shown in FIG. 21, and the cylindrical portion 158*c* of the bearing 158, are guided by the guide 130R of the apparatus main assembly 1, which is shown in FIG. 23(*a*). Further, the pair of cartridge guides 51L, and the cylindrical portion 51*e* of the drum supporting portion 51 of the cartridge 2, are guided by the guide 130L of the main assembly 1, which is shown in FIG. 23(*b*). With the provision of the above described structural arrangement, the cartridge 2 is mounted into, or removed from, the apparatus main assembly 1 in the direction which is practically perpendicular to the axial line of the drive shaft 100.

Figure 28:
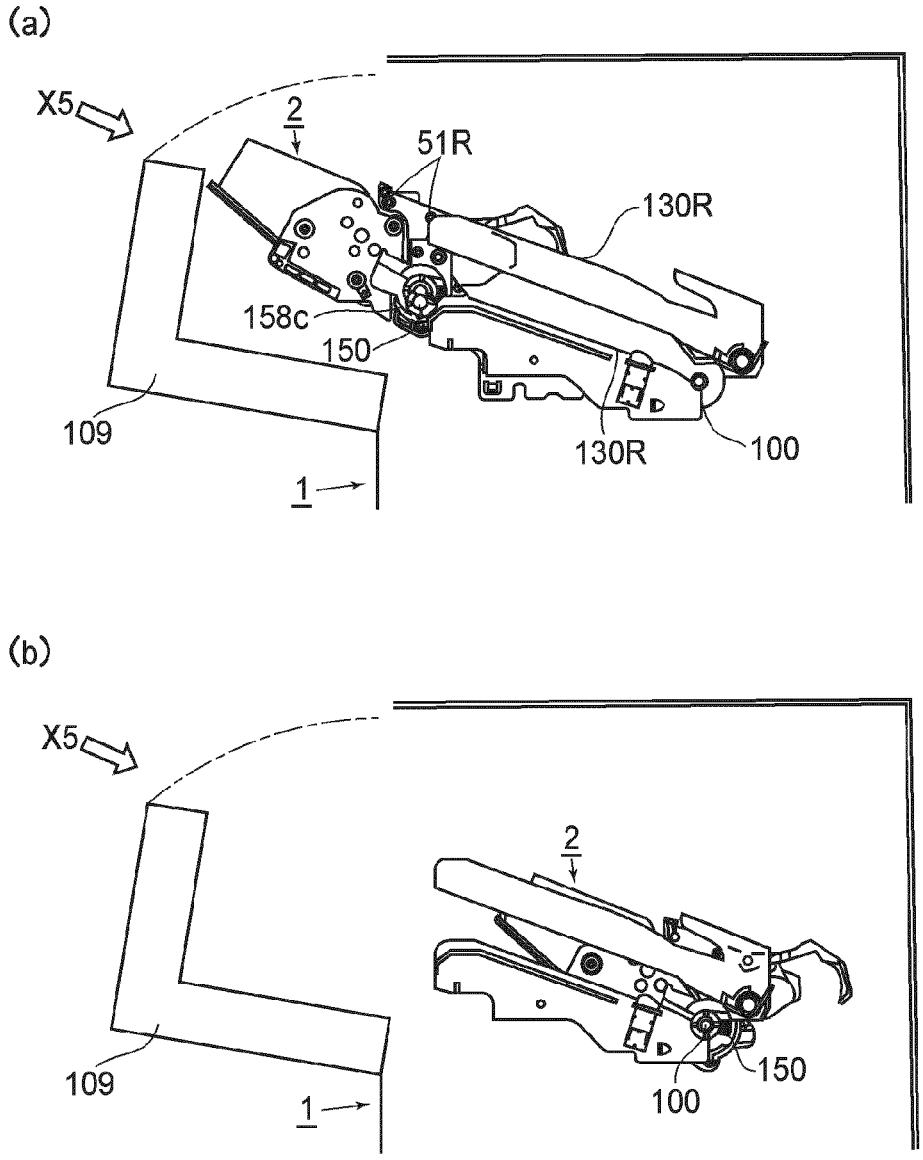
FIGS. 28(*a*) and 28(*b*) are schematic phantom views of the image forming apparatus, showing the method for mounting the process cartridge into the main assembly of the apparatus.

Next, referring to FIGS. 28(*a*) and 28(*b*), the operation for mounting the cartridge 2 into the apparatus main assembly 1 will be described. FIGS. 28(*a*) and 28(*b*) are schematic sectional views of the image forming apparatus shown in FIG. 4, at the plane S1-S1 in FIG. 4, except that in FIGS. 28(*a*) and 28(*b*), there the cartridge 2 is in the apparatus. If a user wants to mount the cartridge 2 into the apparatus main assembly 1, the user is to open the door 109 of the apparatus main assembly 1, and to insert the cartridge 2 into the apparatus main assembly 1, in such a manner that the cartridge guides 51R, and cylindrical portion 158*c* are guided by the guides 130R of the apparatus main assembly 1 (cartridge guide 51L and cylindrical portion 51*e*, which are on opposite side from driving force receiving side, are guided by guide 13L of apparatus main assembly 1), as shown in FIGS. 28(*a*) and 28(*b*), in the direction indicated by an arrow mark X5. As the cartridge 2 is inserted, the coupling 150 of the cartridge 2 engages with the drive shaft 100, and then, the cartridge 2 is placed in a preset position (image forming position). As the same time as the cartridge 2 is placed in the preset position, the coupling 150 becomes fixed in the position and attitude so that the rotational force can be transmitted to the cartridge 2 (FIG. 28(*b*)).

As the cartridge 2 is moved into the abovementioned preset position, the drum shaft bearing portion 158*e* (FIG. 21) of the bearing 158, and the drum shaft bearing portion 51*g* of the drum supporting portion 51 (FIG. 22) come under the pressure from the compression springs 188R and 188L shown in FIGS. 23(*a*) and 23(*b*). As a result, the cartridge 2 is precisely positioned relative to the apparatus main assembly 1.

At this time, why "practically perpendicular" is used instead of "perpendicular" will be described. That is, a small amount of gap is provided between the cartridge 2 and apparatus main assembly 1 to ensure that the cartridge 2 can be smoothly mounted into, or removed from, the apparatus main assembly 1. Thus, it is possible that when the cartridge 2 is mounted into, or removed from, the apparatus main assembly 1, the entirety of the cartridge 2 will become slightly tilted by an angle within the range afforded by the gap. Even in such a case, the present invention is effective. This is why "substantially perpendicular" was used to include the case in which the entirety of the cartridge 2 becomes slightly tilted due to the presence of the abovementioned small amount of gap.

(Movements of Coupling 150)

Figure 29:
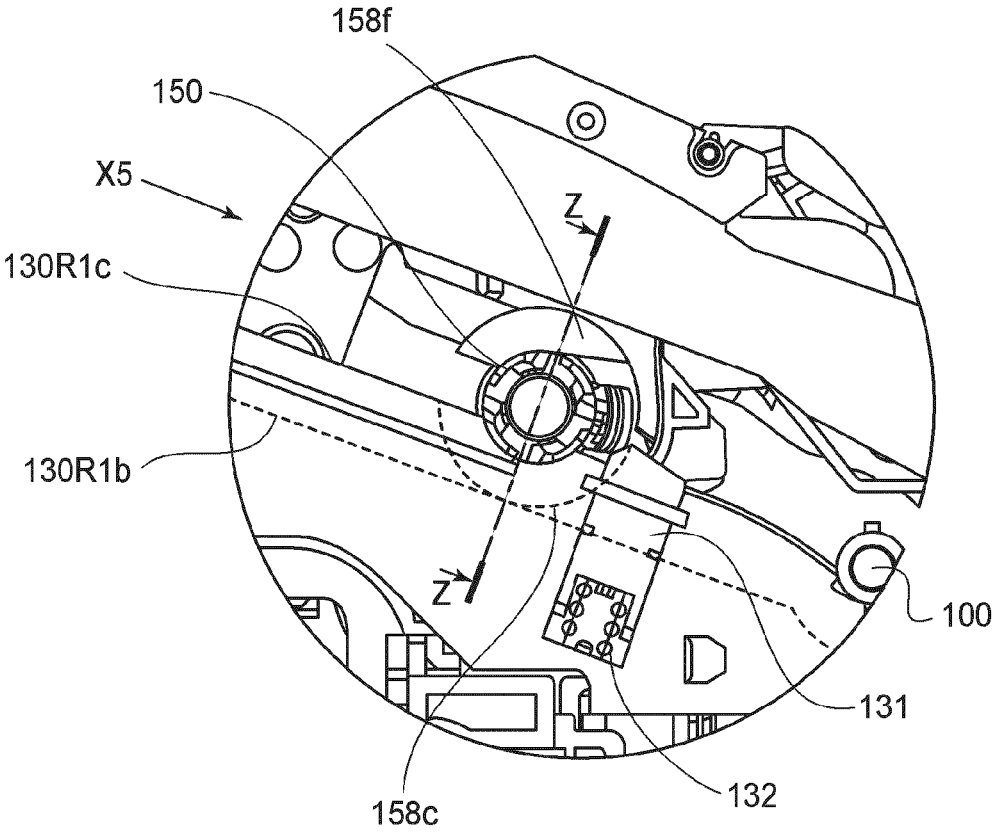
FIG. 29 is a schematic drawing for describing the movements of the coupling, which occur during the insertion of the cartridge into the main assembly of the image forming apparatus.
Figure 30:
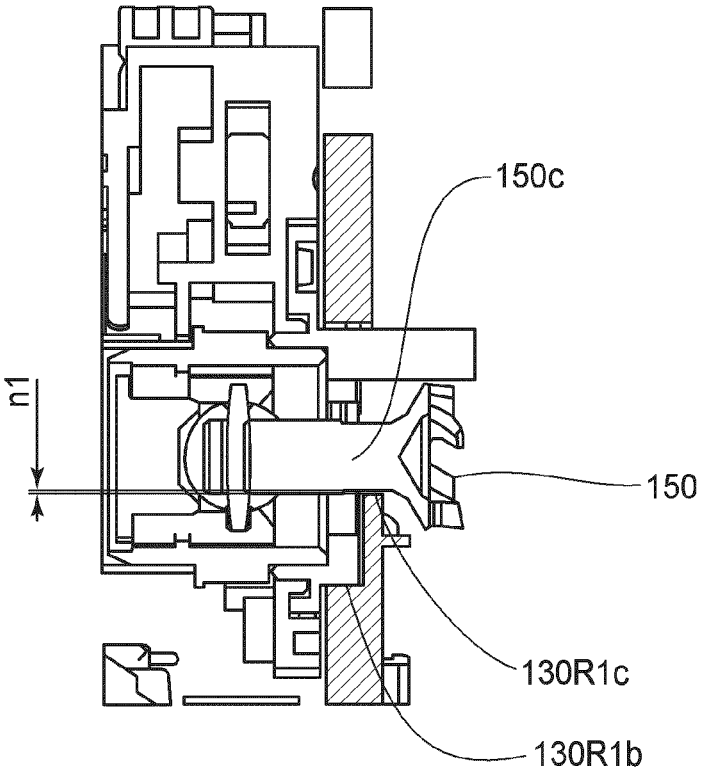
FIG. 30 is also a schematic drawing for describing the movements of the coupling, which occur during the insertion of the cartridge into the main assembly of the image forming apparatus.

Next, referring to FIGS. 29 and 30, the relationship among the guides 130R and 130L, that is, the cartridge guides of the apparatus main assembly 1, the sliders 131, and the coupling 150 will be described. FIG. 29 is a side view of the driving force receiving end portion of the cartridge 2 which is being inserted into the apparatus main assembly 1, as seen from the side where the drive shaft 100 is located. FIG. 30 is a sectional view of the driving force receiving end portion of the cartridge 2, at a plane Z-Z in FIG. 29.

Referring to FIG. 29, when the cartridge 2 is mounted into the apparatus main assembly 1, the driving force receiving end portion of the cartridge 2 moves inward of the apparatus main assembly 1, with the cylindrical portion 158*c* of the bearing 158 remaining in contact with the guiding surface 130R1*b*. During this stage of the mounting, there is a gap n1 between the center portion 150*c* (in terms of lengthwise direction) of the coupling 150 and the guide rib 130R1*c*, as shown in FIG. 30. Therefore, during this state, the coupling 150 is under no pressure. Next, referring to FIG. 29, the top left portion of the peripheral surface of the coupling 150 is in contact with the regulating portion 158*f*. Therefore, the coupling 150 is allowed to tilt only in the direction indicated by the arrow mark X (cartridge mounting direction). The slider 131 is kept in its pressure applying position (uppermost position) by the resiliency of the compression spring 132.

Figure 31:
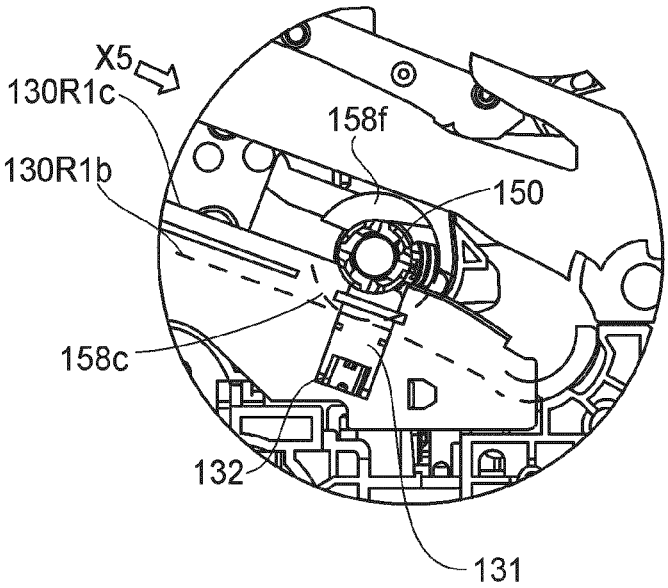
FIG. 31 is yet another schematic drawing for describing the movements of the coupling, which occur during the insertion of the cartridge into the main assembly of the image forming apparatus.

FIG. 31 is a side view of the driving force receiving end portion of the cartridge 2 after the coupling 150 came into contact with the slider 131, and the slider 131 was moved from its pressure applying position to its retreat position. Because of the advancement of the coupling 150, which is capable of tilting only in the direction indicated by the arrow mark X5, into the apparatus main assembly 1, the center portion 150*c* comes into contact with the slanted surface 131*a* (FIG. 32) of the projecting portion of the slider 131. Thus, as the cartridge 2 is inserted further, the slider 131 is pressed down into its retreat position.

Figure 32:
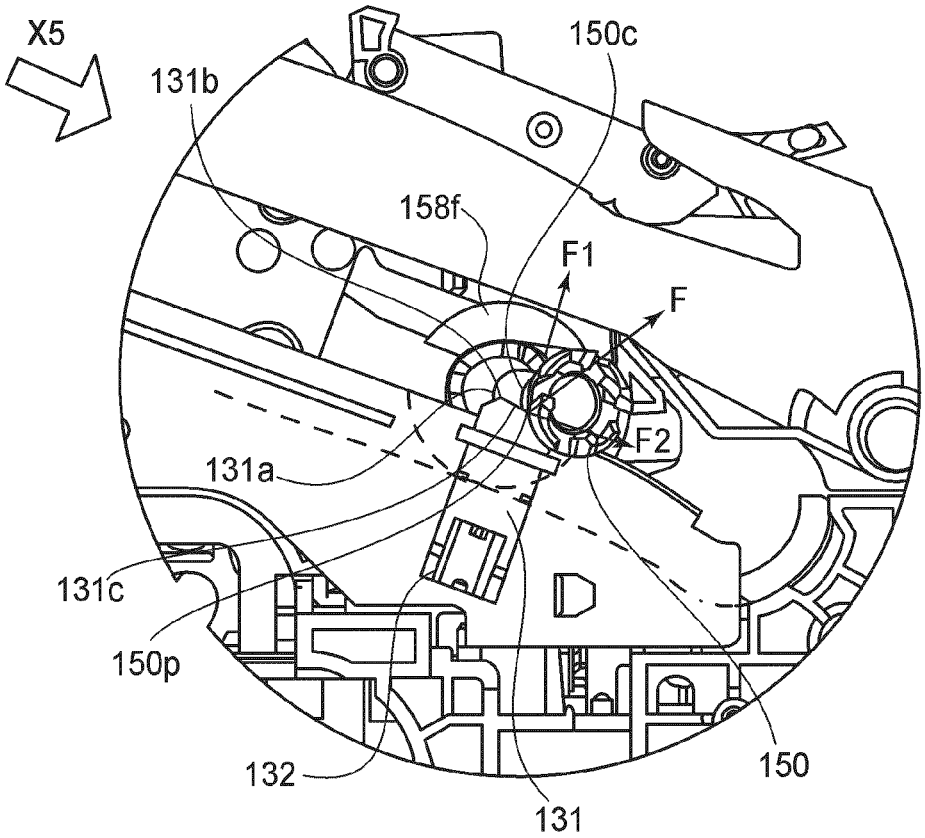
FIG. 32 is another schematic drawing for describing the movements of the coupling, which occur during the insertion of the cartridge into the main assembly of the image forming apparatus.

FIG. 32 shows the state of the driving force receiving end portion of the cartridge 2 after the coupling 150 went over the apex 131*b* of the slider 131. As soon as the coupling 150 goes over the apex 131*b*, the resiliency of the compression spring 132 begins to press the slider 131 out of the retreat position into the pressure applying position. During this stage of the mounting of the cartridge 2, a part of the center portion 150*c* of the coupling 150 is pressed by the slanted surface 131*c* of the slider 131. That is, the slanted surface 131*c* functions as a pressure applying portion, whereas a part of the center portion 150*c* functions as the force catching portion 150*p*, which catches the force F applied by the slanted surface 131*c*. The force F is separated into two components, that is, a force F1 and a force F2. Also during this stage, the coupling 150 is regulated by the regulating portion 158*f*, which is in contact with the top portion of the peripheral surface of the coupling 150. Therefore, the coupling 150 is tilted in the cartridge mounting direction X5 by the force F2. That is, the coupling 150 is moved into its drive shaft engagement starting position, in which the coupling 150 is ready in attitude to become engaged with the drive shaft 100.

Figure 33:
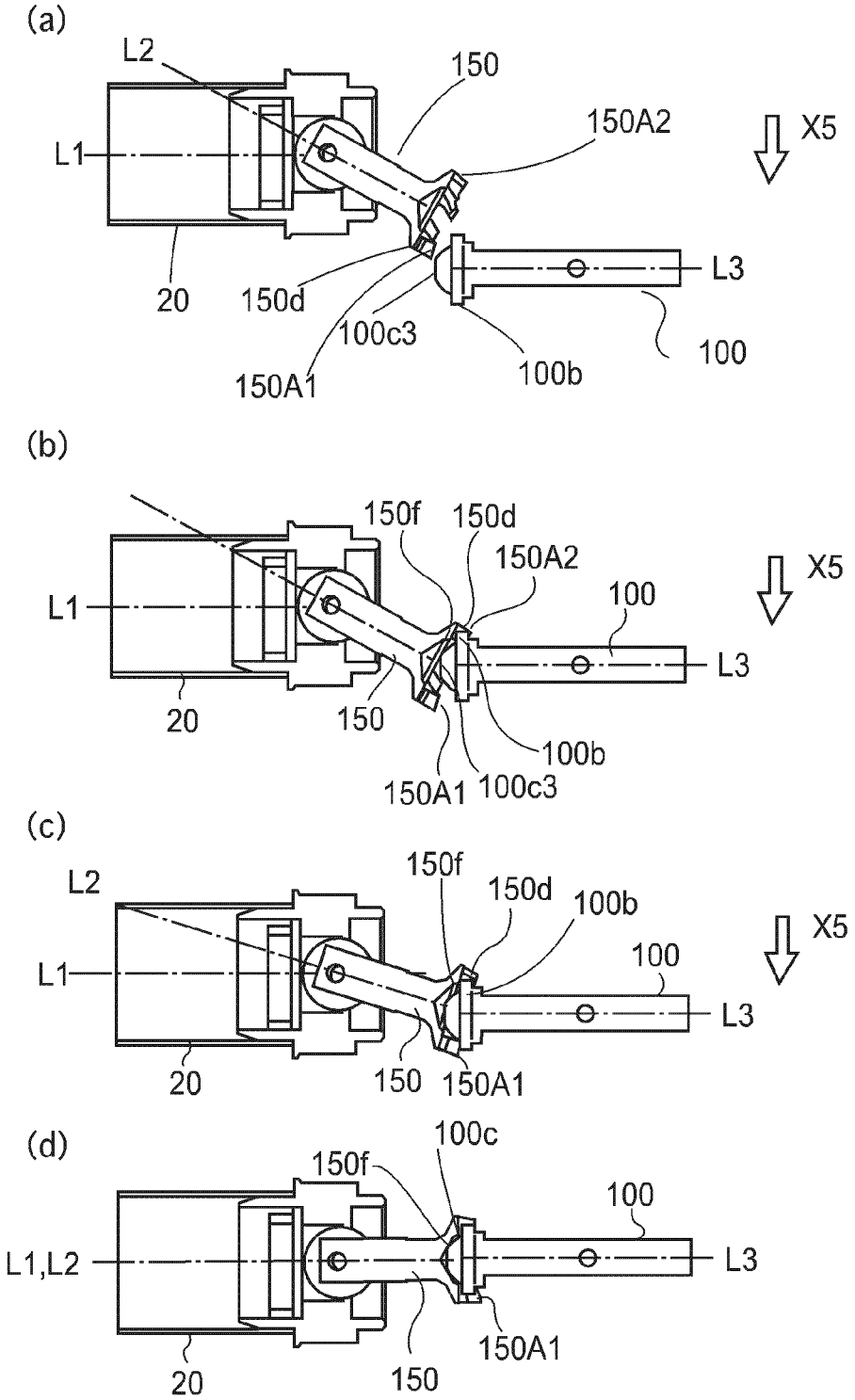
FIGS. 33(*a*)-33(*d*) are yet other schematic drawings for describing the movements of the coupling, which occur during the insertion of the cartridge into the main assembly of the image forming apparatus.

Next, referring to FIGS. 33(*a*)-33(*d*), how the coupling 150 becomes engaged with the drive shaft 100 will be described. FIGS. 33(*a*)-33(*d*) are a vertical sectional views of the driving force receiving end portion of the drum 20, coupling 150, and drive shaft 100, as seen from below the apparatus main assembly 1.

Referring to FIG. 33(*a*), when the cartridge 2 is mounted into the apparatus main assembly 1, the cartridge 2 is moved into the apparatus main assembly 1 (unshown) from the direction (indicated by arrow mark X5), which is practically perpendicular to the axial line L3 of the drive shaft 100. When the coupling 150 is in the abovementioned drive shaft engagement starting position, the axial line L2 of the coupling 150 is tilted relative to the axial line L1 of the drum 20 so that the driving force receiving end of the coupling 150 is on the downstream side of the opposite end of the coupling 150, in terms of the cartridge mounting direction X5. Because the coupling 150 is tilted as described above, the leading end portion 150A1 (part of coupling 150), in terms of the cartridge mounting direction X5, is closer to the drum 20 than to the tip portion 100*c*3 of the drive shaft 100, in terms of the direction parallel to the axial line L1, whereas the leading end portion 150A2 (another part of coupling 150) is closer to the rotational force transmitting pin 100*b* than to the tip portion 100*c*3 of the drive shaft 100.

Referring to FIG. 33(*b*), first, the leading end portion 150A1 passes by the tip portion 100*c*3 of the shaft 100, and then, the surface of the driving force catching conic recess 150*f*, the axial line of which coincides with the axial line of the coupling 150, or driving force catching projection 150*d*, comes into contact with the tip portion 100*c*3 of the drive shaft 100, or the rotational force transmitting pin 100*b*. At this stage, the surface of the driving force catching conic recess 150*f* and/or the driving force catching projection 150*d* is the drive shaft contacting portion on the cartridge side, and the tip portion 100*c*3 and/or rotational force transmitting pin 100*b* is the coupling contacting portion on the main assembly side.

Referring to FIG. 33(*c*), as the cartridge 2 is moved further into the apparatus main assembly 1, the coupling 150 is gradually tilted back so that eventually, its axial line L2 roughly aligns with the axial line L3 of the drive shaft 100.

Next, referring to FIG. 33(*d*), as the cartridge 2 becomes precisely positioned relative to the apparatus main assembly 1, the coupling 150 becomes roughly aligned with the drive shaft 100. That is, the axial line L1 of the drum 20 becomes roughly aligned with the axial line L2 of the coupling 150. At the same time, the coupling 150 is changed in attitude from the drive shaft engaging attitude to the rotational force receiving attitude, which is also the driving force transmitting attitude. In other words, the coupling 150 becomes engaged with the drive shaft 100.

To summarize, the coupling 150 has the recess 150*f*, the axial line of which coincides with the rotational axis of the coupling 150. As the cartridge 2 is moved into the apparatus main assembly 1 in the direction which is practically perpendicular to the axial line L1 of the drum 20, the coupling 150 is changed in attitude from its drive shaft engaging attitude into its driving force receiving (transmitting) attitude. During this stage of the cartridge movement, the coupling 150 tilts in a manner to allow the downstream portion 150A1 of the coupling 150, in terms of the direction in which the cartridge 2 is mounted into the apparatus main assembly 1, to circumvent the drive shaft 100.

After the coupling 150 was moved into its rotational force transmitting position (attitude), the tip of the drive shaft 100 is in the recess 150*f*. Further, as the drive shaft 100 is rotated, the rotational force catching portion 150*e* engages with the rotational force transmitting portion 100*b* of the drive shaft 100, which is the end portion the drive shaft 100 projecting in the direction perpendicular to the axial line of the drive shaft 100. Thus, as the drive shaft 100 is rotated, the coupling 150 receives the rotational force from the drive shaft 100, and is rotated by the received rotational force.

When the coupling 150 is in its drive shaft engagement starting position, the end portion 150A1, which is a part of the coupling 150, is on the drum 20 side of the drive shaft tip portion 100*c*3, whereas when the coupling 150 is in its rotational force transmitting position (attitude), the end portion 150A1 is on the rotational force transmitting pin 100*b* side of the drive shaft tip portion 100*c*3. This movement of the coupling 150 will be expressed as the "circumvention of the drive shaft by a part of the coupling".

Figure 34:
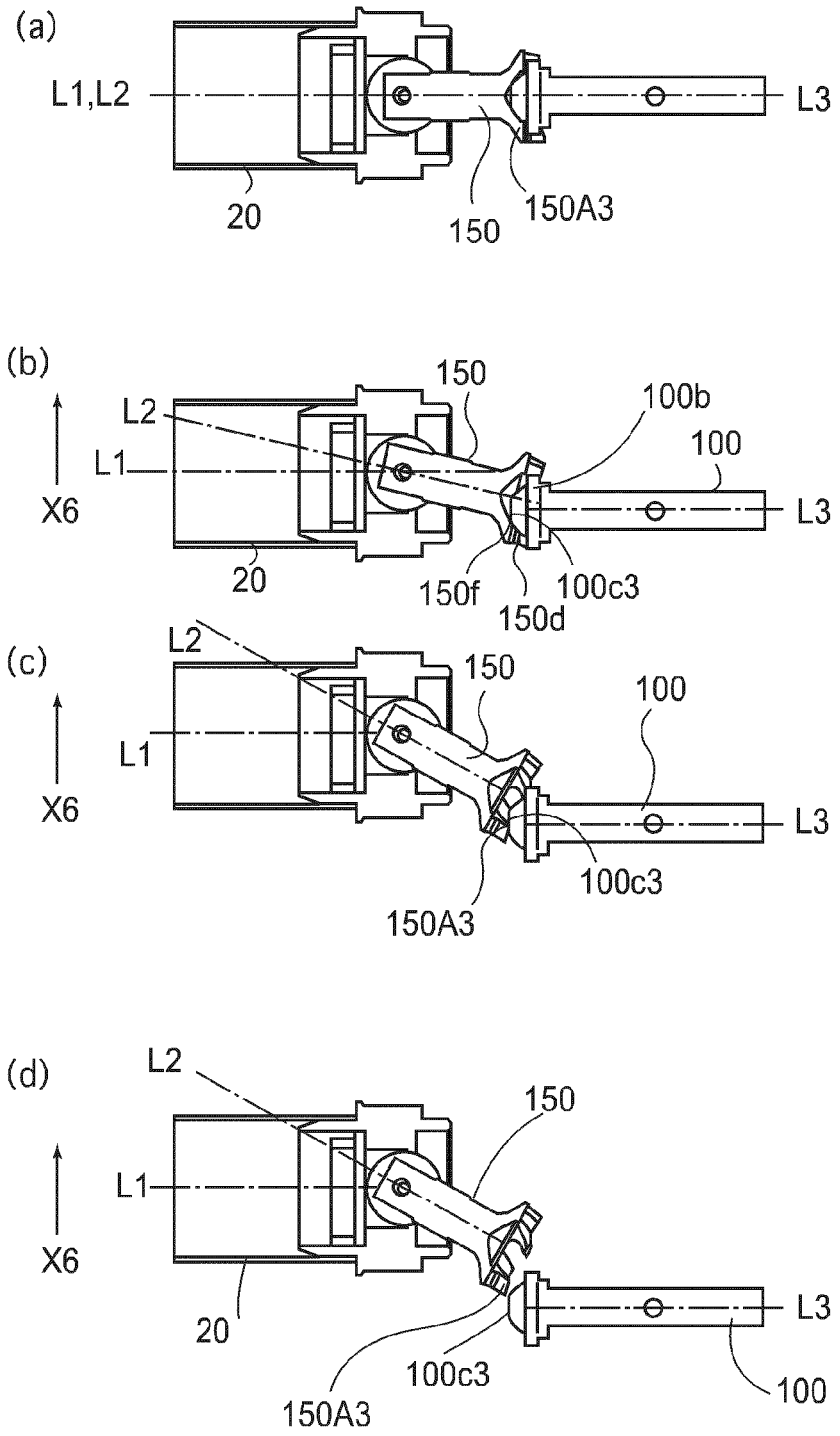
FIGS. 34(*a*)-34(*d*) are schematic drawings for describing the movements of the coupling, which occur during the extraction of the cartridge from the main assembly of the image forming apparatus.

Next, the movements the coupling 150, which occurs when the cartridge 2 is removed from the apparatus main assembly 1 will be described. FIGS. 34(*a*)-34(*d*) are vertical sectional views of the driving force receiving end portion of the drum 20, the coupling 150, and the drive shaft 100, as seen from below the apparatus main assembly 1.

Referring to FIG. 34(*a*), immediately after the driving of the drum 20 is stopped, the coupling 150 is still in the driving force transmitting (receiving) position, in which it is proper in attitude for driving force transmission (reception). That is, the axial line L2 practically coincides with the axial line L1.

Next, referring to FIG. 34(*b*), as the cartridge 2 is moved toward a user (in direction indicated by arrow mark X6), the drum 20 moves toward the user. This movement of the drum 20 causes the recess 150*f* of the coupling 150 or projections 150*d*, to come into contact with at least the tip portion 100*c*3 of the drive shaft 100, beginning therefore to cause the coupling 150 (axial line of the coupling 150) to tilt in such a direction that the driving force receiving end of the coupling 150 is positioned on the downstream side of the opposite end of the coupling 150, in terms of the cartridge removal direction X6. This direction in which the coupling 150 is tilted is the same as the direction in which the coupling 150 is tilted when the cartridge 2 is mounted into the apparatus main assembly 1.

Referring to FIG. 34(*c*), as the cartridge 2 is moved further in the direction X6, the coupling 150 is continuously tilted until the end portion 150A3 of the coupling 150, that is, the upstream end portion of the driving force receiving end of the coupling 150, in terms of the direction X6, reaches the tip portion 100*c*3 of the shaft 100. The position (attitude) of the coupling 150 when the end portion 15A3 reached the tip portion 100*c*3 of the shaft 100, is the drive shaft disengaging position (attitude) of the coupling 150.

Next, referring to FIG. 34(*d*), the coupling 150 passes by the tip portion 100*c*3 while remaining in contact therewith. The angle which the axial lines L1 and L2 form is different from that which they form when the cartridge 2 is mounted into the apparatus main assembly 1. However, the manner in which the end portion 150A3, that is, a part of the coupling 150, circumvents the tip portion 100*c*3 during the removal of the cartridge 2 is the same as that during the mounting of the cartridge 2, except for the direction.

Thus, this movement of the coupling 150 will be also referred to as "circumvention of the drive shaft by a part of the coupling".

Incidentally, the position of the tip 150A3 is affected by the rotational phase of the coupling 150; the position of the tip 150A3 is determined by the rotational phase of the coupling 150 when the coupling 150 is stopped. That is, it may be the projection 150*d*, the arcuate rib 150*g*, or both that will be in contact with the tip portion 100*c*3 of the shaft 100 (FIG. 9). Whether it is the projection 150*d* or the arcuate rib 150*d*, the one which is farthest from the drum 20 constitutes the end portion 150A.

Thereafter, the cartridge 2 can be removed from the apparatus main assembly 1.

That is, when the cartridge 2 is moved out of the apparatus main assembly 1, the movement of the cartridge, which is practically perpendicular to the axial line L1 of the drum 20 causes the coupling 150 to change in attitude from the rotational force transmitting attitude to the drive shaft disengaging attitude. During this movement of the coupling 150, the coupling 150 tilts in a manner to allow the portion 150A3, which is a part of the coupling 150 and is on the rear side of the drive shaft 100 as seen from the direction opposite from the direction in which the cartridge 2 is removed, to circumvent the drive shaft 100, thereby allowing itself to become disengaged from the drive shaft 100.

Further, the cartridge 2 is designed so that the coupling 150 is allowed to gyrate or incline in practically any direction relative to the axial line L1 of the drum 20. Therefore, the coupling 150 can smoothly tilt between the drive shaft engaging attitude and the rotational force transmitting attitude, and between the driving force transmitting attitude and the drive shaft disengaging attitude. Here, "gyration" of the coupling 150 does not mean that the coupling 150 itself rotates about the axial line L1 of the drum 20. It means that the coupling 150 gyrates or inclines as if the axial line L2 of the tilted coupling 150 rotates about the axial line of the drum 20. Further, it does not exclude the phenomenon that the coupling 150 itself rotationally moves about its axial line L2 by an angle which is within the range corresponding to the amount of play or the intentionally provided gap.

That is, the coupling 150 is allowed to gyrate or incline in such a manner that the end portion 150*a* of the coupling 150, that is, the driving force receiving end portion of the coupling 150, draws a circle, the center of which coincides with the axial line L2, with the end portion 150*b* of the coupling 150, that is, the opposite end portion of the coupling 150, remaining on the axial line of the drum 20.

Further, "practically any direction" (in which coupling 150 is capable of gyrating (tilting)) is a direction in a range in which the coupling 150 is allowed to tilt into the rotational force receiving (transmitting) position, regardless of the rotational phase of the drive shaft 100 having the rotational force transmitting portion 100*a*, when a user mount the cartridge 2 into the apparatus main assembly 1.

Further, it is a direction in a range in which the coupling 150 is allowed to tilt into the aforementioned drive shaft disengaging attitude, regardless of the rotational phase of the drive shaft 100, when a user moves the cartridge 2 out of the apparatus main assembly 1.

Further, in order to allow the coupling 150 to tilt in practically any direction relative to the axial line L1, a gap is provided between the pin 155 (rotational transmitting portion), and the rotational force transmitting surface 151*h* (rotational force catching surface) which engages with the pin 155. That is, the coupling 150 is attached to the end of the drum 20 in such a manner that it is allowed to tilt as described above. Therefore, the coupling 150 is capable of tilting in practically any direction relative to the axial line L1.

Further, according to the preferred embodiment described above, the process cartridge 2 can be mounted into, or removed from, the apparatus main assembly 1, which is provided with the drive shaft 100, in the direction which is practically perpendicular to the axial line L3 of the drive shaft 100.

Also according to the preferred embodiment described above, the cartridge driving gear, with which the apparatus main assembly 1 is provided, does not need to be moved forward or backward in the direction of its axial line when the coupling 150 is mounted into, or moved out of, the apparatus main assembly 1, by moving the process cartridge 2 in the direction which is practically perpendicular to the axial line L3 of the drive shaft 100.

The driving force transmitting portion between the apparatus main assembly 1 and the process cartridge 2 in the above described embodiment can rotate the drum 20 more smoothly than a driving force transmitting portion in accordance with the prior art, which is made up of nothing but gears.

(Structure Arrangement for Positioning Coupling)

Figure 20:
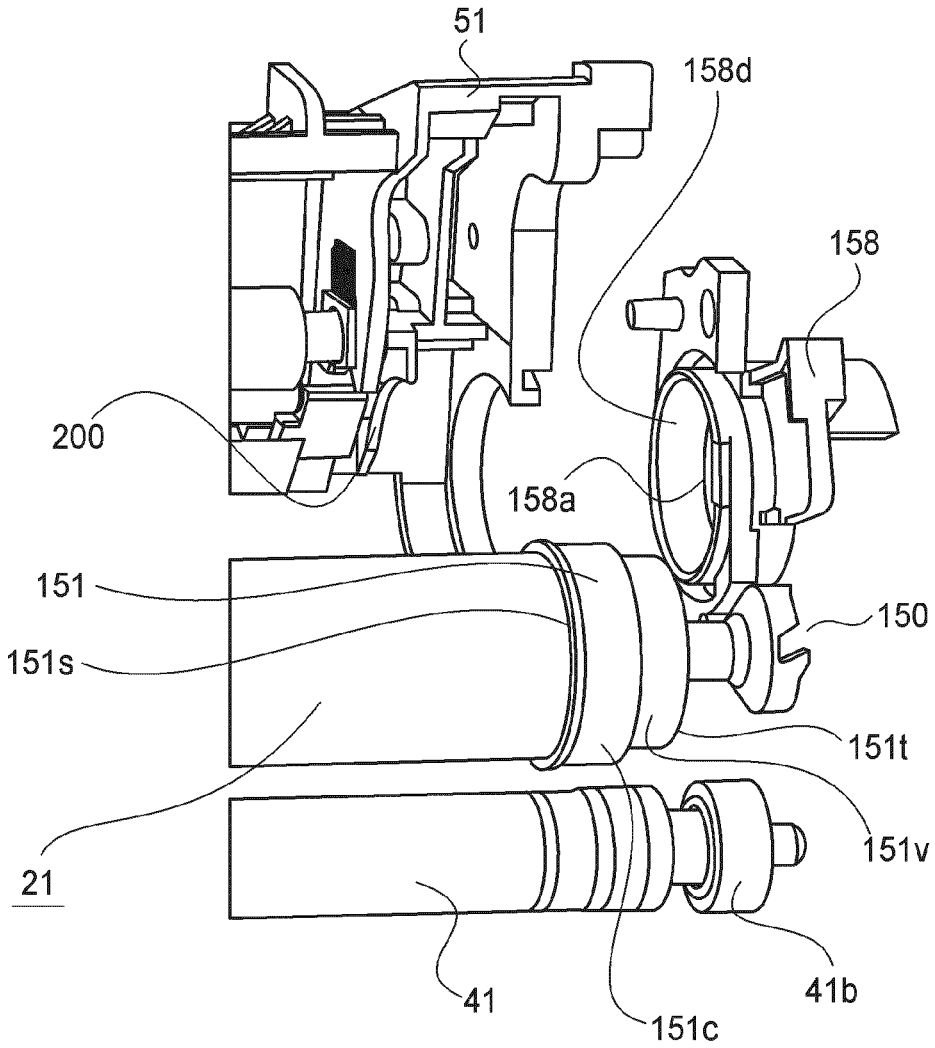
FIG. 20 is also a perspective view of the driving force receiving end portion of the photosensitive drum unit, and its adjacencies, showing the structural arrangement for supporting the driving force receiving end of the photosensitive drum unit.

Next, the structural arrangement for positioning the coupling 150 will be described. FIGS. 19 and 20 are drawings for showing the internal structure of the photosensitive drum unit 21 (inclusive of the coupling 150), the drum supporting portion 51, and the bearing 158. The drum supporting portion 51 has a rib 200 as a drum displacement regulating first portion of the first unit 50. The rib 200 has a tapered portion 200*a* and a tapered portion 200*b*, which are on the upstream and downstream sides of the rib 200 in terms of the rotational direction of the drum 20, respectively. The functions of the tapered portions will be described later.

Incidentally, the cartridge 2 is to be mounted into, or moved out of, the apparatus main assembly 1 by a user in direction which is practically perpendicular to the lengthwise direction of the cartridge 2 (lengthwise direction of drum 20).

The flange 151, which is a part of the first unit 50, has a drum displacement regulating surface 151*s* and a drum displacement regulating surface 151*t*, which are on the coupling side of the flange 151 and the opposite side of the flange 151 from the coupling 151, respectively. In this embodiment, the surface 151*s*, which is a drum displacement regulating means, is one end of the flange 151, in terms of the direction parallel to the axial line of the flange 151, and the surface 151*t*, which is also a drum displacement regulating means, is the other end of the flange 151.

Further, the bearing 158 has a surface 158*a* as the drum displacement regulating second portion of the first unit 50. After the attachment of the photosensitive drum unit 21 to the drum supporting portion 51, with the bearing 158 placed between the photosensitive drum unit 21 and drum supporting portion 51, the rib 200 of the drum supporting portion 51 faces the surface 151*s* of the flange 151, and the surface 151*t* of the flange 151 faces the surface 158*a* of the bearing 158.

FIGS. 21, 22, 23(*a*) and 23(*b*) are drawings for describing the cartridge positioning portions of the cartridge 2 and those of the apparatus main assembly 1. Referring to FIG. 21, the bearing 158 has a groove 158*b* and a cylindrical portion 158*c*. The groove 158*b* is the first cartridge positioning portion of the cartridge, and the cylindrical portion 158*c* is the second cartridge positioning portion of the cartridge. Referring to FIGS. 23(*a*) and 23(*b*), the guiding member 130R of the apparatus main assembly 1 has a rib 130Ra and a recess 130Rb, which are the first and second cartridge positioning portions of the apparatus main assembly 1. As the cartridge 2 is mounted into the apparatus main assembly 1, the rib 130Ra of the apparatus main assembly 1 fits into the groove 158*b* of the cartridge 2, and the cylindrical portion 158*c* of the cartridge 2 fits into the recess 130Rb of the apparatus main assembly 1.

That is, the cartridge 2 has the groove 158*b*, in which the rib 130Ra of the apparatus main assembly 1, which is for regulating the movement of the first unit 50 in terms of the lengthwise direction of the drum 20, when the cartridge 2 is mounted into the apparatus main assembly 1. The groove 158*b* is a part of the first unit 50. Further, the cartridge 2 has the cylindrical portion 158*c*, which fits into the recess 130Rb of the apparatus main assembly 1 to position the cartridge 2 relative to the apparatus main assembly 1 in terms of the radius direction of the drum 20, when the cartridge 2 is mounted into the apparatus main assembly 1. The cylindrical portion 158*c* is located at one of the lengthwise ends of the first unit 50, and its axial line coincides with the axial line of the drum 20.

Referring to FIG. 22, the drum supporting portion 51 has a cylindrical portion 51*e*, which is the cartridge positioning third portion of the cartridge 2. Next, referring to FIG. 23(*b*), the guiding member 130L of the apparatus main assembly 1 has a recess 130La, which is the cartridge positioning third portion of the apparatus main assembly 1. The cylindrical portion 51*e* of the cartridge 2, also fits into the recess 130La of the apparatus main assembly 1 when the cartridge 2 is mounted into the apparatus main assembly 1.

That is, the cartridge 2 has the cylindrical portion 51*e* which fits into the recess 130La to position the cartridge 2 relative to the apparatus main assembly 1 in terms of the radius direction of the drum 20 when the cartridge 2 is mounted into the apparatus main assembly 1. The cylindrical portion 51*e* is a part of the opposite end of the first unit 50 from the driving force receiving end, and its axial line coincides with the axial line of the drum 20.

As described above, when the cartridge 2 is mounted into the apparatus main assembly 1, the rib 130Ra of the apparatus main assembly 1 fits into the groove 158*b* of the cartridge 2, as the cartridge 2 is moved into a preset position, while leaving a small amount of a gap (play) between the two (rib 130Ra and wall of groove 138*b*) in terms of the lengthwise direction of the drum 20. Therefore, it is ensured that even if the two are slightly misaligned relative to each other when the cartridge 2 is moved into the preset position, the former eventually fits into the latter in the satisfactory manner.

Further, the catching surface 51*f* of the cylindrical portion of the drum supporting portion 51, shown in FIG. 21, engages with the catching portion of the guiding member 130R shown in FIGS. 23(*a*) and 23(*b*).

With the provision of the above described structural arrangement, it is ensured that the cartridge 2 is satisfactorily positioned relative to the apparatus main assembly 1.

Next, referring to FIGS. 23(*a*) and 23(*b*), the positional relationship between the drive shaft 100 of the apparatus main assembly 1 and the coupling 150 of the cartridge 2 will be described.

Figure 24:
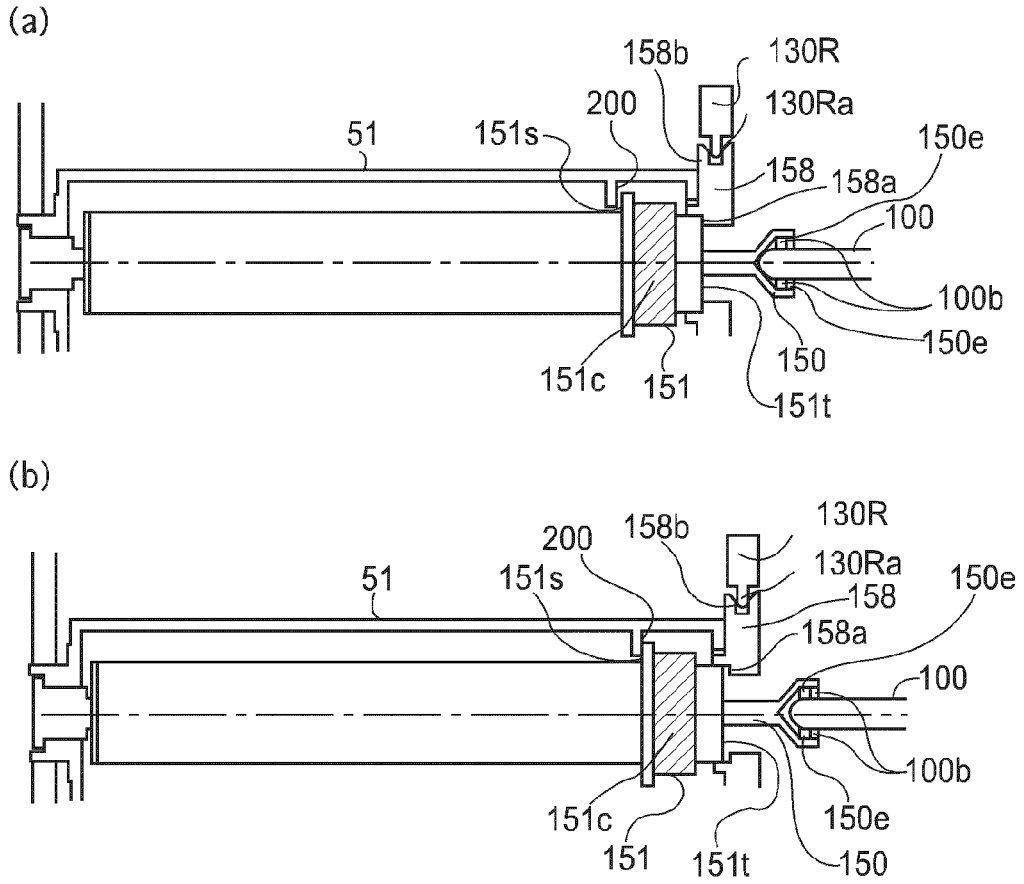
FIGS. 24(*a*) and 24(*b*) are schematic drawings for showing the structural arrangement for precisely positioning the coupling and apparatus main assembly relative to each other in terms of the direction parallel to the axial line of the coupling.

FIGS. 24(*a*) and 24(*b*) are schematic drawings of the cartridge positioning structure of the cartridge 2 and the cartridge positioning structure of the apparatus main assembly 1. FIG. 24(*a*) represents the case where the coupling 150 has moved toward the drive shaft 100. As described above, the positional relationship between the bearing 158 and guide 130R in terms of the lengthwise direction is set by the engagement of the rib 130Ra of the guide 130R of the apparatus main assembly 1 into the groove 158*b* of the bearing 158. The rib 130Ra, which fits into the groove 158*b*, with the presence of a small amount of play, is on the drive shaft side of the groove 158*b*. Further, the positional relationship between of the bearing 158 and flange 151 in terms of the lengthwise direction, is regulated by the contact between the surface 158*a* of the bearing 158 and the surface 151*t* of the flange 151. When the two surfaces 158*a* and 151*t* are in contact with each other, the surface 151*s* of the flange 151 and the rib 200 of the drum supporting portion 51 are not in contact with each other; there is a small amount of gap between them.

FIG. 24(*b*) shows the case in which the coupling 150 has moved away from the drive shaft 100. That is, the position of the bearing 158 and the position of the guide 130 are determined by the fitting of the rib 130Ra of the guide 130R of the apparatus main assembly 1 into in the groove 150*b* of the bearing 158. However, the rib 130Ra, which is in the groove 158*b*, is on the side opposite from the drive shaft 100. Further, the surface 158*a* of the bearing 158 is not in contact with the surface 151*t* of the flange 151; there is a small amount of a gap between them. The positional relationship between the flange 151 and drum supporting portion 51 in terms of the lengthwise direction, is regulated by the contact between the surface 151*s* of the flange 151 and the rib 200 of the drum supporting portion 51.

Therefore, regardless of whether the rib 130Ra is on the drive shaft side, or on the side opposite from the drive shaft, it is ensured that the rotational force transmitting pin 100*b* of the drive shaft 100, and the rotational force catching portion 150*e* of the coupling 150, maintain such a positional relationship that is necessary to transmit the driving force.

(Description of Tapered Portions 200*a* and 200*b*)

Figure 25:
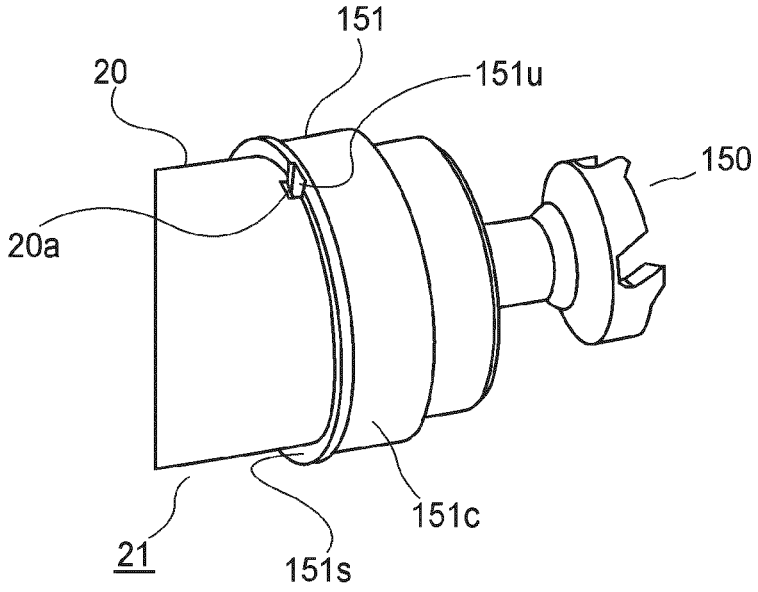
FIG. 25 is a perspective view of the photosensitive drum and flange, showing the method for securely attaching the drum flange to the photosensitive drum.

As described above with reference to FIG. 24(*b*), when the photosensitive drum unit 21 is assembled as a part of the first unit 50, the surface 151*s* of the flange 151 sometimes rubs against the rib 200 of the drum supporting portion 51. It is possible that if the rib 200 fits into the recess 151*u* of the flange 151 as shown in FIG. 25, the drum 20 will fail to rotate at a constant speed, which results in the formation of an unsatisfactory image. The recess 151*u* of the flange 151 is necessary if the drum 20 and the flange 151 are joined by crimping during the manufacturing of the cartridge 2.

At this time, the meaning of "crimping" will be briefly described. In the case of this embodiment, "crimping" is a method for solidly attaching the drum 20 and flange 151 to each other by cutting and bending the end portion of the drum 20 (cut and bent portion 20*a*). It is one of the methods for solidly attaching the drum 20 and flange 151 to each other, and has long been used. Incidentally, there are cases where bonding, press-fitting, or the like is used, instead of "crimping" to attach the drum 20 and flange 151 to each other.

Figure 26:
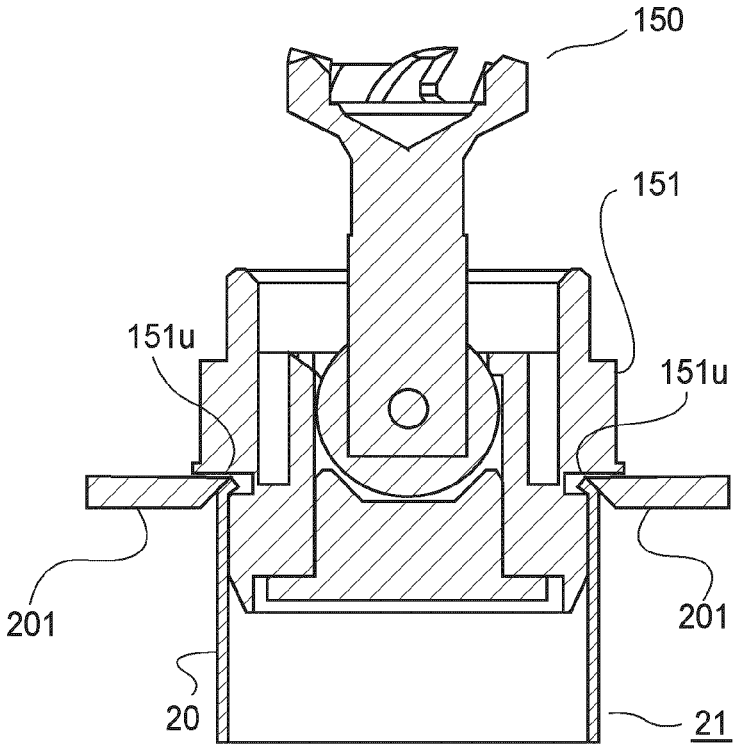
FIG. 26 is a sectional view of the photosensitive drum and drum flange, which is for showing the method for securely attaching them to each other.

Referring to FIG. 26, the drum 20 and flange 151 are held against each other, with the drum 20 pressed against the end surface 151*s* (unshown in FIG. 26, although shown in FIGS. 24(*a*) and 24(*b*)). Then, the end portion of the drum 20, which corresponds in position to the groove of the flange 151, is cut and bent with the use of a tool 201 so that the drum 20 and flange 151 are held to each other by the bent portion of the drum 20. This is why the end surface 151*s* (FIG. 25) of the flange 151 is provided with the recesses 151*u*, which function as a clearance recess.

In this embodiment, the photosensitive drum unit 21 is made by fastening the drum 20 and flange 151 to each other by crimping.

Figure 27:
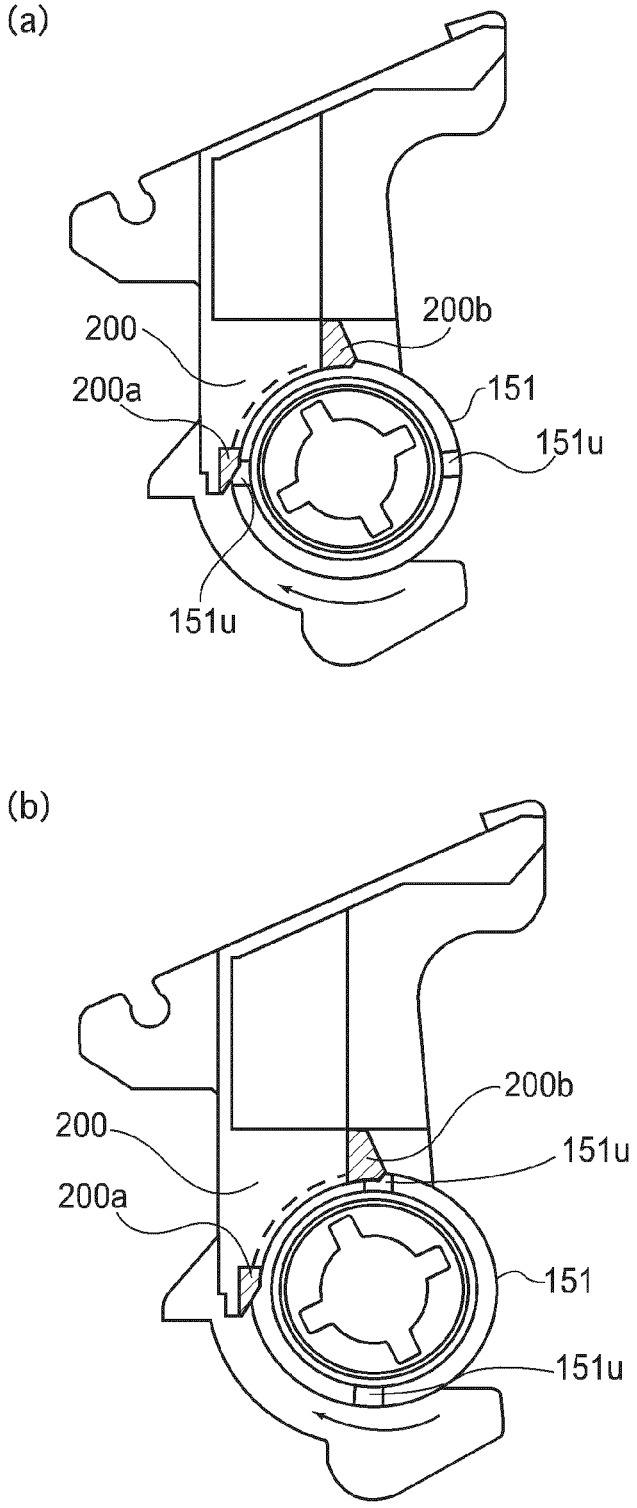
FIGS. 27(*a*) and 27(*b*) are sectional views of the drum supporting portion of the cartridge frame, and the groove of the drum flange, showing their positional relationship.

Next, the relationship between the recess 151*u* and rib 200 will be described. Referring to FIGS. 27(*a*) and 27(*b*), the rib 200 extends in a manner to contact a part of the peripheral surface of the flange 151. The flange 151 receives the rotational force (rotational driving force) from the apparatus main assembly 1, and rotates in the direction indicated by an arrow mark. Thus, it is possible that as the flange 151 rotates, the rib 200 will hang up in the recess 151*u* at two locations, that is, the location where the rib 200 begins to fit into the recess 151*u* (state shown in FIG. 27(*a*)), and the location where the rib 200 begins to come out of the recess 151*u* (state shown in FIG. 27(*b*)). If the rib 200 hangs up in the recess 151*u* as described above, the drum 20 becomes unstable in rotational speed. In this embodiment, the flange 151 has two recesses 151*u*. Therefore, there are four opportunities per rotation of the flange 151 that the rib 200 will hang up.

Thus, the upstream and downstream edges of the rib 200 in terms of the rotational direction of the flange 151 are beveled to create tapered portions 200*a* and 200*b* to make it unlikely for the rib 200 to hang up in the recesses 151*u*. That is, the upstream and downstream edges of the rib 200 in terms of the rotational direction of the flange 151 have the slanted surfaces 200*b* and 200*a*, respectively, created by beveling the two edges, as shown in FIG. 19. The hatched areas in FIGS. 27(*a*) and 27(*b*) correspond to the beveled edges (tapered portions 200*a* and 200*b*) of the rib 200. The provision of these tapered portions 200*a* and 200*b* made it possible to reduce the frequency with which an unsatisfactory image attributable to unstable rotation of the drum 20 is produced.

Thus, the cartridge 2 is highly precisely positioned relative to the apparatus main assembly 1, as described above. In other words, the above described structural arrangement made it unnecessary to structure the apparatus main assembly 1 so that the abovementioned rotational member of the apparatus main assembly could be moved in the direction parallel to the axial line of the rotational member, and also, made it possible to reduce in size an image forming apparatus, and a process cartridge therefor, compared to an image forming apparatus in accordance with the prior art, and a process cartridge therefor, respectively.

Further, the above described embodiment of the present invention makes it possible to improve an image forming apparatus in terms of the accuracy with which an electrophotographic photosensitive drum is rotatable, compared to an image forming apparatus, in which the rotational force is transmitted from the apparatus main assembly to the process cartridge therein, through the meshing of the gear of the apparatus main assembly, and the gear of the process cartridge.

Incidentally, according to the present invention, the clattering, vibrations, etc., which occur when the cartridge 2 is mounted into the apparatus main assembly 1 can be reduced, and also, it is possible to reduce in size the main assembly of an image forming apparatus, and a process cartridge therefor, compared to the counterparts in accordance with the prior art.

The following is the summary of the above given description of the structure of the process cartridge 2.

(1) The process cartridge 2 is removably mountable in the main assembly of an electrophotographic image forming apparatus having the rotational force transmitting portion 100*a*. The process cartridge 2 has: the electrophotographic photosensitive drum 20; the development roller 41 for developing an electrostatic latent image formed on the electrophotographic photosensitive drum 20; and the first unit 50 which supports the electrophotographic photosensitive drum 20. The cartridge 2 also has the second unit 40 which supports the development roller 41 and is connected to the first unit 50 so that it is movable relative to the first unit 50 in an oscillatory manner. Further, the cartridge 2 has the coupling 150 by which the cartridge 2 receives the rotational force for rotating the electrophotographic photosensitive drum 20, from the apparatus main assembly 1, when the cartridge 2 is in the preset image forming position in the apparatus main assembly 1. The coupling 150 is attached to one of the lengthwise ends of the electrophotographic photosensitive drum 20. The cartridge 2 also has the cartridge positioning first portion 158*b*, which engages with the cartridge positioning first portion 130Ra of the apparatus main assembly 1. The cartridge positioning first portion 158*b* of the cartridge 2 regulates the movement of the first unit 50 in terms of the lengthwise direction of the electrophotographic photosensitive drum, when the cartridge 2 is in the apparatus main assembly 1. Further, the cartridge 2 has the cartridge positioning second portion 158*c*, which engages with the cartridge positioning second portion 130Rb of the apparatus main assembly 1. This cartridge positioning second portion of the 158*c* of the cartridge 2 positions the electrophotographic photosensitive drum relative of the apparatus main assembly 1 in terms of the radial direction of the electrophotographic photosensitive drum 20, when the cartridge 2 is in the apparatus main assembly 1. The cartridge positioning second portion 158*c* of the cartridge 2 is attached to one of the lengthwise ends of the first unit 50, and its axial line coincides with the axial line of the electrophotographic photosensitive drum 20. Further, the cartridge 2 has the cartridge positioning third portion 51*e*, which engages with the cartridge positioning third portion 130La of the apparatus main assembly 1. The cartridge positioning third portion 51*e* of the cartridge 2 positions the electrophotographic photosensitive drum 20 relative to the apparatus main assembly 1, in terms of the radial direction of the photosensitive drum 20, when the cartridge 2 is in the apparatus main assembly 1. The cartridge positioning third portion 51*e* of the cartridge 2 is attached to the other lengthwise end of the first unit 50, and its axial line coincides with that of the electrophotographic photosensitive drum 20. Moreover, the cartridge 2 has the drum displacement first portion 200, which is a part of the first unit 50 of the cartridge 2, and regulates the displacement of the electrophotographic photosensitive drum 20 in terms of the lengthwise direction of the first unit 50. The photosensitive drum unit 21 has the drum displacement regulating first portion 151*s* for regulating the displacement of the electrophotographic photosensitive drum 20 in terms of the lengthwise direction of the first unit 50. The first regulating portion 151*s* regulates the abovementioned displacement of the electrophotographic photosensitive drum 20 by coming into contact with the first regulating portion 200 of the first unit 50.

With the provision of the above described structural arrangement, the coupling 150 of the process cartridge 2, which receives the rotational force from the apparatus main assembly 1, and the rotational force transmitting portion 100*b* of the apparatus main assembly 1, can be precisely positioned relative to each other in terms of the direction parallel to the axial line of the rotational force transmitting portion 100*b*. Further, the drum 20 can be precisely positioned relative to the apparatus main assembly 1 in terms of the direction parallel to its axial line.

(2) The first regulating portion 151*s* of the flange 151 regulates the displacement of the electrophotographic photosensitive drum 20 toward the opposite end of the first unit 50 (cartridge 2) from the driving force receiving end. Further, the flange 151 has the second regulating portion 151*t*, which regulates the displacement of the electrophotographic photosensitive drum 20 toward the driving force receiving end of the first unit 50. The drum flange 151 is attached to the electrophotographic photosensitive drum 20 in such as manner that the second regulating portion 151*t* of the flange 151 regulates the abovementioned displacement of the electrophotographic photosensitive drum 20 by coming into contact with the second regulating portion 158*a* of the first unit 50.

With the provision of the above described structural arrangement, it is possible to regulate the displacement of the photosensitive drum 20 in the direction parallel to its axial line. Therefore, it is possible to ensure that the drum 20 is precisely position, and remains precisely positioned, relative to the apparatus main assembly 1 in terms of the direction parallel to the axial line of the drum 20, and also, that the coupling 150 is precisely positioned, and remains precisely positioned, relative to the apparatus main assembly 1 in terms of the direction parallel to the axial line of the coupling 150.

(3) The electrophotographic photosensitive drum 20 is provided with the drum flange 151, which is attached one of the lengthwise ends of the electrophotographic photosensitive drum 20. The above described coupling 150 is attached to the drum flange 151 in such a manner that it is allowed to tilt relative to the drum flange 151. Further, the bearing 158 for rotatably supporting the shaft portion of the drum flange 151 is attached to the drum supporting portion 51. The abovementioned first positioning portion 158*b* of the cartridge 20 is a part of the bearing 158, and so is the second regulating portion of the first unit 50. Further, the drum displacement regulating first portion 151*s* is an integral part of the drum flange 151, and so is the drum regulating second portion 151*t*.

With the provision of the above described structural arrangement, it is possible to precisely position the coupling 150 of the cartridge 2, which receives a rotational force from the apparatus main assembly 1, and the rotational force transmitting portion 100*a* of the apparatus main assembly 1, relative to each other in terms of the direction parallel to the axial line of the rotational force transmitting portion 100*a*.

(4) The drum flange 151 has the gear 151*c*, which transmits the rotational force which the coupling 150 received from the apparatus main assembly 1, to the development roller 41.

With the employment of the above described structural arrangement, it is possible to integrate multiple components into a single components, and therefore, it is possible to reduce in cost an electrophotographic image forming apparatus. Further, the employment of the above described structural arrangement makes it possible to reduce in width the gears, and therefore, it is possible to provide an electrophotographic image forming apparatus which is significantly smaller in size than an electrophotographic image forming apparatus in accordance with the prior art.

(5) The coupling 150 receives the rotational force for rotating the electrophotographic photosensitive drum 20, by engaging with the rotational force transmitting portion 100*b* of the drive shaft 100 of the apparatus main assembly 1. Further, the coupling 150 can change in attitude into the drive force transmitting (receiving) attitude in which it can transmit the driving force for rotating the electrophotographic photosensitive drum 20, to the electrophotographic photosensitive drum 20. The coupling 150 can also change in attitude to assume the drive shaft engaging attitude in which it tilts relative to the axial line of the electrophotographic photosensitive drum 20 in such a direction that the driving force receiving end of the coupling 150 is positioned on the downstream side of the opposite end of the coupling 150, in terms of the cartridge mounting direction, and also, the drive shaft disengaging attitude in which the driving force receiving end of the coupling 150 is positioned on the downstream side of the opposite end of the coupling 150, in terms of the cartridge removal direction. When a user inserts the process cartridge 2 into the apparatus main assembly 1, in the direction perpendicular to the axial line of the electrophotographic photosensitive drum 20, in order to mount the cartridge 2 in the apparatus main assembly 1, the coupling 150 is changed in attitude from the drive shaft engagement starting attitude into the rotational force transmitting attitude, in which the coupling 150 faces the drive shaft 100. Further, when the cartridge 2 is moved out of the apparatus main assembly 1 in the direction perpendicular to the axial line of the electrophotographic photosensitive drum 20, the coupling 150 is changed in attitude from the rotational force transmitting attitude into the drive shaft disengagement starting position, thereby disengaging from the drive shaft 100.

The above described structural arrangement makes it possible to provide a process cartridge which can be mounted into the main assembly of an image forming apparatus, which does not have the mechanism for moving the rotational member, as the rotational force transmitting portion, of the apparatus main assembly, which is for transmitting a rotational force to the electrophotographic photosensitive drum 20, in the direction parallel to the axial line of the rotational member, by utilizing the opening or closing movement of the cover (door) of the apparatus main assembly 1.

(6) The coupling 150 has the recess 150*f*, the axial line of which coincides with the axial line of the coupling 150. As the process cartridge 2 is mounted into the apparatus main assembly 1 in the direction perpendicular to the axial line of the electrophotographic photosensitive drum 20, the coupling 150 is changed in attitude from the drive shaft engagement starting attitude into the rotational force transmitting attitude. As the coupling 150 is changed in attitude, it tilts in a manner to allow its downstream portion, in terms of the direction in which the process cartridge 2 is mounted into the apparatus main assembly 1, to circumvent the drive shaft 100. Then, as the coupling 150 is moved into the drive shaft engagement starting attitude, it covers the tip of the drive shaft 100 in a manner to embracing the tip of the drive shaft 100 with its recess 151*e*. Then, as the drive shaft 100 is rotated by the rotational force transmitted thereto, the rotational force catching portion 150*e* engages with the rotational force transmitting portion 100*b*, which projects from the end portion of the drive shaft 100 in the direction perpendicular to the axial line of the drive shaft 100. Thus, as the drive shaft 100 is rotated, the coupling 150 receives the rotational force from the drive shaft 100, and is rotated by the rotational force it received from the drive shaft 100. When it is necessary to move the process cartridge 2 from the apparatus main assembly 1, a user (operator) is to pull the process cartridge 2 in the direction perpendicular to the axial line of the electrophotographic photosensitive drum 20. As the process cartridge 2 is pulled, the coupling 150 tilts in such a manner that its attitude changes from the rotational force transmitting attitude to the drive shaft disengaging attitude. That is, it tilts in such a manner to allow its portion, which is behind the drive shaft 100, as seen from the direction opposite from the direction in which the process cartridge 2 is moved out of the apparatus main assembly 1, to circumvent the drive shaft 100, enabling thereby the coupling 150 to separate from the drive shaft 100.

The above described structural arrangement makes it possible to provide a process cartridge which can be mounted into the main assembly of an electrophotographic image forming apparatus which does not have the mechanism for moving the rotational member of the apparatus main assembly 1, that is, the rotational force transmitting portion of the apparatus main assembly 1, in the direction parallel to the axial line of the rotational member.

(7) The first regulating portion 200 of the first unit 50 has the tapered portions 200*a* and 200*b*, which correspond in position to the downstream and upstream sides of the first regulating portion 200 of the first unit 50 in terms of the rotational direction of the drum flange 151.

This structural arrangement made it possible to provide a process cartridge, the electrophotographic photosensitive drum of which is significantly less irregular in rotational speed, that is, significantly higher in the accuracy in rotational speed, than that of a process cartridge in accordance with the prior art.

(8) The process cartridge 2 is removably mountable in the main assembly 1 of an electrophotographic image forming apparatus having the rotational force transmitting portion 100*a*. It also has the electrophotographic photosensitive drum 20, and the drum flange 151, which is attached to one of the lengthwise ends of the electrophotographic photosensitive drum 20, and has the gear 151*c* and drum shaft 151*v*. It also has the coupling 150 which receives the rotational force for rotating the electrophotographic photosensitive drum 20, from the rotational force transmitting portion 100*a*, while it is in its proper position for image formation, in the apparatus main assembly 1. This coupling 150 is attached to the drum flange 151. Further, the cartridge 2 has the development roller 41, which is for developing the electrostatic latent image formed on the electrophotographic photosensitive drum 20, and which rotates by receiving the rotational force which the coupling 150 received from the apparatus main assembly 1. Further, the process cartridge 2 has: the first frame unit 50, which supports one of the lengthwise ends of the electrophotographic photosensitive drum 20, with the presence of the bearing 153, which supports the corresponding end of the drum shaft 151*v*, between the first frame unit 153 and the lengthwise end of the drum shaft 151*v*; and the second frame unit 40, which supports the development roller 41, and which is connected to the first frame unit 50 in such a manner that it is allowed to move relative to the first frame unit 50 in an oscillatory manner. Further, the process cartridge 20 has the cartridge positioning first portion 158*b*, which is an integral part of the bearing 158 and positions the process cartridge 2 relative to the apparatus main assembly 1 by engaging with the cartridge positioning first portion 130Ra of the apparatus main assembly 1. This structural arrangement regulates the movement of the first frame unit 50 in terms of the direction parallel to the lengthwise direction of the electrophotographic photosensitive drum 20 while the process cartridge 2 is in its image forming position in the apparatus main assembly 1. The process cartridge 20 also has the cartridge positioning second portion 158*c* which positions the electrophotographic photosensitive drum 20 relative to the apparatus main assembly 1 in terms of the radial direction of the electrophotographic photosensitive drum 20, by engaging with the cartridge positioning second portion 130Rb of the apparatus main assembly 1, when the process cartridge 2 is mounted into the apparatus main assembly 1. The axial line of the cartridge positioning second portion 158*c* coincides with the axial line of the electrophotographic photosensitive drum 20. The process cartridge 2 also has the cartridge positioning third portion 51*e*, which is at the opposite end of the first unit 50 from the driving force receiving end, and which positions the electrophotographic photosensitive drum 20 relative to the apparatus main assembly 1 in terms of the radial direction of the electrophotographic photosensitive drum 20, by engaging with the cartridge positioning third portion 130La of the apparatus main assembly 1 at about the same time as the process cartridge 2 is moved into its image forming portion in the apparatus main assembly 1. The axial line of the cartridge positioning third portion 51*e* of the process cartridge 2 coincides with the axial line of the electrophotographic photosensitive drum 20. Further, the process cartridge 2 has the drum displacement regulating first portion 200, which is a part of the first unit 50, which is located close to the driving force receiving end of the first unit 50 to regulate the displacement of the electrophotographic photosensitive drum 20 toward the opposite side from the driving force receiving side, in terms of the lengthwise direction of the first unit 50. Further, the process cartridge 2 has the drum displacement regulating second portion 158*a* for regulating the displacement of the electrophotographic photosensitive drum 20 toward the driving force receiving end of the first unit 50 in terms of the lengthwise direction of the first unit 50. The drum displacement regulating second portion 158*a* is an integral part of the bearing 158. Further, the process cartridge 2 has the drum displacement regulating portion 151*t* which is placed in contact with the drum displacement regulating second portion of the first unit 50 to regulate the drum displacement toward the opposite side from the driving force receiving end of the first unit 50 in terms of the lengthwise direction of the first unit 50. The drum displacement regulating second portion 151*t* is an integral part of the drum flange 151.

The described structural arrangement makes it possible to more precisely position the coupling 150 of the process cartridge 2, which receives a driving force from the apparatus main assembly 1, and the rotational force transmitting portion 100*a* of the apparatus main assembly 1, relative to each other in terms of the axial line of the rotational force transmitting portion 100*a*, than the structural arrangement in accordance with the prior art.

(9) The first drum displacement regulating portion 151*s* is a part of one end of the drum flange 151, and the second drum displacement regulating portion 151*t* is a part of the other end of the drum flange 151 in terms of the direction parallel to the axial line of the drum flange 151.

This structural arrangement makes component integration possible for cost reduction. It also makes it possible to reduce the gear 151*c* in tooth width, making is possible to provide an electrophotographic image forming apparatus which is significantly smaller in size than a comparable apparatus in accordance with the prior art.

(10) The downstream and upstream edges of the drum displacement regulating portion 200 of the first frame unit 50, in terms of the rotational direction of the drum flange 151, are beveled, thereby providing the tapered portions 200*a* and 200*b*.

This structural arrangement makes it possible to reduce the electrophotographic photosensitive drum 20 in the irregularity in the rotational speed, making it possible to provide an electrostatic image forming apparatus which was significantly more accurate in rotational speed of the photosensitive drum 20 than a comparable apparatus in accordance with the prior art.

(11) The electrophotographic image forming apparatus structured so that the process cartridge 2 is removably mountable in its main assembly has: i) cartridge positioning first portion 130Ra; ii) cartridge positioning second portion 130Rb; iii) cartridge positioning third portion 130La; and iv) rotational force transmitting portion 100*a*; v) the process cartridge structured as described below. The image forming apparatus employs the process cartridge 2 structured as follow: The process cartridge 2 has the electrophotographic photosensitive drum 20, and the development roller 41 for developing the electrostatic latent image formed on the electrophotographic photosensitive drum 20. The process cartridge 2 also has the first frame unit 50 which supports the electrophotographic photosensitive drum 20, and the second frame unit 40 which supports the development roller 41 and is connected to the first frame unit 50 so that it is allowed to move relative to the first frame unit 50 in an oscillatory manner. The process cartridge 2 also has the coupling 150 for receiving the rotational force for rotating the electrophotographic photosensitive drum 20, from the rotational force transmitting portion 100*a*, when the process cartridge 2 is in its image forming position in the apparatus main assembly 1. The coupling 150 is attached to one of the lengthwise ends of the electrophotographic photosensitive drum 20. The process cartridge 2 has the cartridge positioning first portion 158*b*, which engages with the cartridge positioning first portion of the apparatus main assembly 1 to regulate the displacement of the first unit 50 in terms of the lengthwise direction of the electrophotographic photosensitive drum 20, virtually at the same time as the process cartridge 2 is moved into its image forming position in the apparatus main assembly 1. Further, the process cartridge 2 has the cartridge positioning second portion 158*c*, which engages with the cartridge positioning second portion of the apparatus main assembly 1 to precisely position the electrophotographic photosensitive drum 20 relative to the apparatus main assembly 1 in terms of the radial direction of the electrophotographic photosensitive drum 20, virtually at the same time as the process cartridge 2 is moved into its image forming position in the apparatus main assembly 1. The cartridge positioning second portion 158*c* is located at one of the lengthwise end of the first unit 50, and its axial line coincides with that of the electrophotographic photosensitive drum 20. The process cartridge 2 has the drum positioning third portion 51*e* which engages with the drum positioning third portion of the apparatus main assembly 1 to precisely position the electrophotographic photosensitive drum 20 relative to the apparatus main assembly 1, in terms of the radial direction of the electrophotographic photosensitive drum 20, virtually at the same time as the process cartridge 2 is moved into its image forming position in the apparatus main assembly 1. The drum positioning third portion 51*e* is attached to the other lengthwise end of the first unit 50, and its axial line coincides with that of the electrophotographic photosensitive drum 20. Further, the process cartridge 2 has the drum displacement regulating first portion 200 for regulating the displacement of the electrophotographic photosensitive drum 20 in the direction parallel to the lengthwise direction of the first unit 50. The drum displacement regulating first portion 200 is an integral part of the first unit 50. The process cartridge 2 has the drum displacement regulating first portion 151*s*, with which the drum flange 151 is provided to regulate the drum displacement in the direction parallel to the lengthwise direction of the first unit 50, by coming into contact with the drum displacement regulating portion of the first unit 50.

The above described structural arrangement makes it possible to provide an electrophotographic image forming apparatus in which a process cartridge capable of precisely positioning its coupling 151 for receiving the rotational force from the apparatus main assembly 1, relative to the rotational force transmitting portion of the apparatus main assembly 1, in terms of the direction parallel to the axial line of the rotational force transmitting portion, can be removably mounted.

(12) The drum displacement regulating first portion 151*s* of the drum flange 151 is the portion of the drum flange 151, which is for regulating the displacement of the electrophotographic photosensitive drum 20 toward the lengthwise end of the first unit 50, which is opposite from the rotational force input end of the first unit 50. Further, the bearing 158 is provided with the drum displacement regulating second portion 158*a*, and the drum flange 151 is provided with drum displacement regulating second portion 151*t*, which regulates the displacement of the electrophotographic photosensitive drum 20 toward the opposite lengthwise end of the first unit 50 from the rotational force input end, by engaging with the drum displacement regulating second portion 158*a* of the first unit 50.

This structural arrangement makes it possible to prevent the displacement of the drum 20 in the direction parallel to the axial line of the drum 20, making it possible to ensure that the drum 20 is precisely position relative the apparatus main assembly 1 in terms of the direction parallel to the axial line of the drum 20.

(13) The drum unit 21 is provided with the drum flange 151, which is attached to one of the lengthwise end of the electrophotographic photosensitive drum 20. To the drum flange 151, the coupling 150 is attached in such a manner that not only is the coupling 150 allowed to tilt relative to the axial line of the latter, but also, it is allowed to move relative to the drum flange 151 in terms of the direction parallel to the axial line of the drum flange 151. Further, the photosensitive drum unit 21 is provided with the bearing 158 for rotatably supporting the drum flange 151. The bearing 158 is attached to the drum supporting portion 51 of the frame of the first unit 50. The drum positioning first portion 158*b* of the cartridge 2, and the drum positioning second portion 158*a* of the cartridge 2, are integral parts of the bearing 158. Further, the drum displacement regulating first portion 151*s* and the drum displacement regulating second portion 151*t* are integral parts of the drum flange 151.

This structural arrangement can precisely position the coupling 150 of the process cartridge 2, which is for receiving the rotational force from the apparatus main assembly 1, relative to the rotational force transmitting portion of the apparatus main assembly 1 in terms of the direction parallel to the rotational force transmitting portion, at an even higher level of precision.

(14) The drum flange 151 has the gear 151*c*, which transmits to the development roller 41 the rotational force which the coupling 150 received from the apparatus main assembly 1.

This structural arrangement makes component integration possible for cost reduction. It also makes it possible to reduce the gear in tooth width, making it thereby possible to provide an electrophotographic image forming apparatus which is significantly smaller in size than a comparable image forming apparatus in accordance with the prior art.

(15) The coupling 150 is the component for receiving the rotational force for rotating the electrophotographic photosensitive drum 20, by engaging with the rotational force transmitting portion 100*b* which the drive shaft 100 of the apparatus main assembly 1 is provided. The coupling 150 is enabled to change in attitude to assume the rotational force transmitting attitude, the drive shaft engaging attitude, in which the axial line of the coupling 150 is tilted relative to the axial line of the electrophotographic photosensitive drum 20 in such a manner that the rotational force receiving end of the coupling 150 is offset from the axial line of the electrophotographic photosensitive drum 20, and the drive shaft disengaging attitude, in which the axial line of the 150 is also tilted relative to the axial line of the electrophotographic photosensitive drum 20 in such a manner that the rotational force receiving end of the coupling 150 is offset from the axial line of the electrophotographic photosensitive drum 20. When the process cartridge 2 is mounted into the apparatus main assembly 1 by being moved in the direction perpendicular to the axial line of the electrophotographic photosensitive drum 20, the coupling 150 is changed in attitude from the drive shaft engaging attitude into the rotational force transmitting attitude, whereby it is made to squarely face the drive shaft 100. When the process cartridge 2 is moved out of the apparatus main assembly 1 in the direction perpendicular to the axial line of the electrophotographic photosensitive drum 20, the coupling 150 is changed in attitude from the rotational force transmitting attitude into the drive shaft disengaging attitude, whereby the coupling 150 is allowed to disengage from the drive shaft 100.

This structural arrangement makes it possible to provide an electrophotographic image forming apparatus describable as follows: an electrophotographic image forming apparatus, the main assembly of which has no mechanism for moving its rotational force transmitting rotational member, in the direction parallel to the axial line of the rotational member, and in which a process cartridge is removably mountable by the utilization of the opening or closing movement of the cover (door) of the apparatus main assembly.

(16) The coupling 150 has the recess 150*f*, the axial line of which coincides with that of the coupling 150. As the process cartridge 2 is moved in the direction X5, which is perpendicular to the axial line L1 of the electrophotographic photosensitive drum 20 to be mounted into the apparatus main assembly 1, the coupling 150 is changed in attitude from the drive shaft engaging attitude into the rotational force transmitting attitude. During this movement of the process cartridge 2, the coupling 150 tilts in such a manner that the downstream portion 150A1 of the coupling 150, in terms of the direction in which the process cartridge 2 is mounted into the apparatus main assembly 1, is allowed to circumvent the drive shaft 100. When the coupling 150 is in the rotational force transmitting position (attitude), the tip portion 100*c*3 is covered with the coupling 150; the tip portion 100*c*3 is in the recess 150*f* of the coupling 150. Further, the coupling 150 has the rotational force catching portions 150*e*, which project from the driving force receiving end of the coupling 150 in the direction perpendicular to the axial line of coupling 150. As the drive shaft 100 rotates, the driving force catching portions 150*e* engage with the rotational force transmitting portions 100*b*, one for one, which project from the driving force transmitting end of the drive shaft 100 in the direction perpendicular to the axial line of the drive shaft 100, and therefore, the coupling 150 rotates by receiving the rotational force from the drive shaft 100. When it is necessary to move the process cartridge 2 out of the apparatus main assembly 1, the process cartridge 2 is to be moved in the direction perpendicular to the axial line of the electrophotographic photosensitive drum 20. As the process cartridge 2 is moved, the coupling 150 is changed in attitude (tilted) from the rotational force transmitting attitude into the drive shaft disengaging attitude, and is disengaged from the drive shaft 100. During this movement of the process cartridge 2, the coupling 150 tilts in such a manner that a part of the rear portion of the coupling 150, as seen from the direction opposite to the direction in which the process cartridge 2 is removed from the apparatus main assembly 1, is allowed to circumvent the drive shaft 100.

This structural arrangement makes it possible to provide an electrophotographic image forming apparatus describable as follows: an electrophotographic image forming apparatus, the main assembly of which has no mechanism for moving its rotational force transmitting rotational member, in the direction parallel to the axial line of the rotational member, and in which a process cartridge is removably mountable by the utilization of the opening or closing movement of the cover (door) of the apparatus main assembly.

(17) The downstream and upstream ends of the drum displacement regulating portion 200 of the first unit 50, in terms of the rotational direction of the drum flange 151, has the tapered portions 200*a* and 200*b*.

This structural feature can reduce the irregularity in the rotational speed of the electrophotographic photosensitive drum 20, making it possible to provide a process cartridge 2 (electrophotographic image forming apparatus), the photosensitive drum 20 of which is significantly higher in the level of precision with which it rotates, than a comparable photosensitive drum in accordance with the prior art.

(18) The electrophotographic image forming apparatus employing the process cartridge 2 removably mountable in its main assembly has: i) the cartridge positioning portion 130Ra; ii) the cartridge positioning second portion 130Rb; the cartridge positioning third portion 130La; and the rotational force transmitting portion 100*a*; and v) the process cartridge 2 structured as described below. The process cartridge 2 has the drum flange 151 having the gear 151*c* and drum shaft portion 151*v*. The drum flange 151 is attached to the drive force receiving end of the electrophotographic photosensitive drum 20. The process cartridge 2 also has the coupling 150 attached to the drum flange 151 to receive the rotational force for rotating the electrophotographic photosensitive drum 20 from the rotational force transmitting portion 100*a*, when the process cartridge 2 is in its image forming position in the apparatus main assembly 1. The process cartridge 2 also has the development roller 41, which is for developing the electrostatic latent image formed on the electrophotographic photosensitive drum 20, and which rotates by receiving the rotational force which the coupling 150 received from the apparatus main assembly 1. Further, the process cartridge 2 has: the first frame unit 50, which supports the drum shaft portion 151*v* of the drum flange 151 attached to the driving force receiving end of the electrophotographic photosensitive drum 20, with the presence of the bearing 158 between the drum shaft portion 151*v* and the first unit 50, and also, supports the opposite end of the electrophotographic photosensitive drum 20 from the driving force receiving end, by the drum shaft 202.

The process cartridge 2 has the second frame unit 40, which supports the development roller 41. The second frame unit 40 is connected to the first frame unit 50 in such a manner that it is allowed to move relative to the first frame unit 50 in an oscillatory manner. Further, the process cartridge 2 has the cartridge positioning first portion 158*b*, which is an integral part of the bearing 158. The cartridge positioning first portion 158*b* precisely positions the process cartridge 2 relative to the apparatus main assembly 1 by engaging with the cartridge positioning first portion 130Ra of the apparatus main assembly 1. This structural arrangement regulates the displacement of the first frame unit 50 in terms of the direction parallel to the lengthwise direction of the electrophotographic photosensitive drum 20 while the process cartridge 2 is in its image forming position in the apparatus main assembly 1. The process cartridge 2 has the cartridge positioning second portion 158*c*, which engages with the cartridge positioning second portion 130Rb of the apparatus main assembly 1. The cartridge positioning second portion 158*c* is an integral part of the bearing 158 located at the driving force receiving end of the first unit 50, and its axial line coincides with that of the electrophotographic photosensitive drum 20. This structural arrangement keeps the process cartridge 2 precisely positioned relative to the apparatus main assembly 1 in terms of the direction parallel to the radius direction of the electrophotographic photosensitive drum 20, while the process cartridge 2 is in its image forming position in the apparatus main assembly 1. Further, the process cartridge 2 has the cartridge positioning third portion 51*e*, which engages with the cartridge positioning third portion 130La of the apparatus main assembly 1. The cartridge positioning third portion 51*e* is an integral part of the drum supporting portion 51 of the opposite end of the first unit 50 from the driving force receiving end, and its axial line coincides with that of the electrophotographic photosensitive drum 20. This structural arrangement keeps the process cartridge 2 precisely positioned relative to the apparatus main assembly 1 in terms of the direction parallel to the radius direction of the electrophotographic photosensitive drum 20, after the mounting of the process cartridge 2 into the apparatus main assembly 1. Further, the process cartridge 2 has the drum displacement regulating first portion 200 for regulating the drum displacement toward the opposite end of the first unit 50 (process cartridge 2) from the driving force receiving end. The drum displacement regulating first portion 200 is an integral part of the driving force receiving end of the first unit 50. The process cartridge 2 also has the drum displacement regulating second portion 158*a* for regulating the drum displacement toward the driving force receiving end of the first unit 50 (process cartridge 2). The drum displacement regulating portion 158*a* is an integral part of the bearing 158. Further, the process cartridge 2 has the drum displacement regulating portion 151*s* for regulating the drum displacement toward the opposite end of the first unit 50 (process cartridge 2). The drum displacement regulating first portion 151*s* is an integral part of the drum flange 151. The process cartridge 2 has the drum displacement regulating second portion 151*t* for regulating the drum displacement toward the drive force receiving end of the first unit 50 by coming into contact with the drum displacement regulating second portion 158*a* of the bearing 158. The drum displacement regulating second portion 151*t* is an integral part of the drum flange 151.

These structural arrangements make it possible to provide an electrophotographic image forming apparatus in which a process cartridge capable of precisely positioning its coupling 150 for receiving rotational force from the main assembly 1 of the image forming apparatus, relative to the rotational force transmitting portion of the apparatus main assembly 1, in terms of the direction parallel to the axial line of the rotational member, is removably mountable.

The drum displacement regulating first portion 151*s* is one of the end portions of the drum flange 151, in terms of the direction parallel to the axial line of the drum flange 151, and the drum displacement regulating second portion 151*t* on the drum side is the other end portion of the drum flange 151.

This structural arrangement makes it possible to reduce a process cartridge (electrophotographic image forming apparatus) in cost by component integration. It also makes it possible to reduce the gear 151*c* in tooth width, making it possible to reduce a process cartridge (image forming apparatus) in size.

(20) The drum displacement regulating first portion 200 on the first unit 50 has the tapered portions 200*a* and 200*b*, which are at the upstream and downstream ends of the regulating portion 200 in terms of the rotational direction of the drum flange 151.

The structural arrangement can reduce the electrophotographic photosensitive drum 20 in the irregularity in rotational speed, and therefore, can improve the electrophotographic photosensitive drum 20 in the level of precision at which it rotates.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 161529/2008 filed Jun. 20, 2008 which is hereby incorporated by reference.

What is claimed is:

1. A process cartridge comprising:

an electrophotographic photosensitive drum;

a developing roller that develops a latent image provided on said electrophotographic photosensitive drum, a drum flange fixed to one longitudinal end of said electrophotographic photosensitive drum;

a coupling member that receives a rotating force for rotating said electrophotographic photosensitive drum and transmits the rotating force to said electrophotographic photosensitive drum through said drum flange;

a first regulating portion that regulates movement of said electrophotographic photosensitive drum in a direction from the one longitudinal end of said electrophotographic photosensitive drum to the other longitudinal end of said electrophotographic photosensitive drum; and a second regulating portion that regulates movement of said electrophotographic photosensitive drum in a direction from the other longitudinal end of said electrophotographic photosensitive drum to the one longitudinal end of said electrophotographic photosensitive drum, wherein said drum flange has (i) a first regulated portion capable of being regulated by said first regulating portion, (ii) a second regulated portion capable of being regulated by said second regulating portion, (iii) a connecting portion that is connected with said coupling member so that a rotational axis of said coupling member is inclineable relative to a rotational axis of said drum flange, and (iv) a gear portion that transmits the rotational force from said coupling member to said developing roller.

2. A process cartridge according to claim 1, wherein said first regulating portion is provided at one end of said drum flange, and said second regulating portion is provided at the other end of said drum flange.

3. A process cartridge according to claim 1, further comprising a bearing member rotatably supporting said drum flange, wherein said bearing member includes said second regulating portion.

4. A process cartridge according to claim 3, further comprising a frame to which said bearing member is fixed, wherein said frame includes said first regulating portion.

5. A process cartridge according to claim 4, wherein said gear portion is positioned between said first regulated portion and said second regulated portion.

6. A process cartridge according to claim 5, further comprising a tapered portion provided at each of both ends, with respect to a rotational direction of said drum flange, of said first regulating portion.

* * * * *